US007399398B2

(12) United States Patent
Rakestraw et al.

(10) Patent No.: US 7,399,398 B2
(45) **Date of Patent: *Jul. 15, 2008**

(54) VARIABLE POTENTIAL ELECTROKINETIC DEVICES

(75) Inventors: David J. Rakestraw, Livermore, CA (US); David W. Neyer, Castro Valley, CA (US)

(73) Assignee: Eksigent Technologies, LLC, Dublin, CA (US)

( * ) Notice: Subject to any disclaimer, the term of this patent is extended or adjusted under 35 U.S.C. 154(b) by 876 days.

This patent is subject to a terminal disclaimer.

(21) Appl. No.: 10/788,629

(22) Filed: Feb. 26, 2004

(65) Prior Publication Data

US 2004/0163959 A1 Aug. 26, 2004

Related U.S. Application Data

(63) Continuation of application No. 10/066,528, filed on Jan. 31, 2002, now Pat. No. 6,719,535.

(51) Int. Cl.
*G01N 27/453* (2006.01)

(52) U.S. Cl. ..... 204/600; 204/601

(58) Field of Classification Search ..... 204/600–605, 204/450–455

See application file for complete search history.

(56) References Cited

U.S. PATENT DOCUMENTS

| | | | | |
|---|---|---|---|---|
| 3,427,978 A | | 2/1969 | Hanneman et al. | 417/48 |
| 3,923,426 A | | 12/1975 | Theeuwes | 204/630 |
| 4,789,801 A | | 12/1988 | Lee | |
| 4,908,112 A | * | 3/1990 | Pace | 210/198.2 |
| 5,116,471 A | | 5/1992 | Chien et al. | |
| 5,296,115 A | * | 3/1994 | Rocklin et al. | 204/454 |
| 5,632,876 A | | 5/1997 | Zanzucchi et al. | |
| 5,766,435 A | | 6/1998 | Liao et al. | |
| 5,961,800 A | | 10/1999 | McBride et al. | |
| 6,013,164 A | | 1/2000 | Paul et al. | 204/450 |
| 6,019,882 A | | 2/2000 | Paul et al. | 204/450 |
| 6,159,353 A | * | 12/2000 | West et al. | 204/601 |
| 6,171,067 B1 | | 1/2001 | Parce | 417/48 |
| 6,224,728 B1 | | 5/2001 | Oborny et al. | |
| 6,277,257 B1 | | 8/2001 | Paul et al. | 204/450 |
| 6,572,749 B1 | * | 6/2003 | Paul et al. | 204/450 |
| 6,619,925 B2 | * | 9/2003 | Ohkawa | 417/48 |
| 6,719,535 B2 | | 4/2004 | Rakestraw et al. | 417/50 |

(Continued)

OTHER PUBLICATIONS

Ye et al. ("Capillary electrochromatography with a silica column with dynamically modified cationic surfactant," Journal of Chromatography A, 855 (1999) 137-145).*

(Continued)

*Primary Examiner*—Alex Noguerola
(74) *Attorney, Agent, or Firm*—Jeffrey G. Sheldon; Michael Fedrick; Sheldon Mak Rose & Anderson

(57) ABSTRACT

Variable potential electrokinetic devices and electrokinetic multipliers used for pumping and flow control are disclosed that offer improvements in safety and design flexibility. The devices of the present invention take advantage of combinations of pumping conduits and conducting conduits to permit the use of lower operating voltages in pumps, pressure multipliers, and flow controllers. Devices having N pumping stages and 2N+1 electrodes permit the use of arbitrary voltages at the fluid connection points between the devices and other system components, further improving device safety and flexibility.

10 Claims, 15 Drawing Sheets

U.S. PATENT DOCUMENTS 6,770,183 B1 * 8/2004 Hencken et al. ..... 204/600
6,960,285 B2 * 11/2005 Schoeniger et al. ..... 204/450

OTHER PUBLICATIONS

Chaiyasut et al. ("Estimation of the dissociation constants for functional groups on modified and unmodified gel supports from the relationship between electroosmotic flow velocity and pH," Electrophoresis 2001, 22, 1267-1272).*

Takamura, Y., et al., "Low-Voltage Electroosmosis Pump and Its Application to On-Chip Linear Stepping Pneumatic Pressure Source," Abstract, Micro Total Analysis Systems, 2001, pp. 230-232.

Office Action for U.S. Appl. No. 10/066,528 mailed on Mar. 25, 2003, 11 pages.

Notice of Allowance for U.S. Appl. No. 10/066,528 mailed on Oct. 21, 2003, 8 pages.

* cited by examiner b.

a.

VARIABLE POTENTIAL ELECTROKINETIC DEVICES

CROSS-REFERENCE TO RELATED APPLICATIONS

This is a continuation application claiming priority from U.S. patent application Ser. No. 10/066,528, filed Jan. 31, 2002, now U.S. Pat. No. 6,719,535 the contents of which are hereby incorporated by reference.

STATEMENT REGARDING FEDERALLY SPONSORED RESEARCH

Not applicable.

REFERENCE TO A MICROFICHE APPENDIX

Not applicable.

BACKGROUND OF THE INVENTION

The invention pertains to the fields of fluid handling and electroosmotic flow. More particularly, the invention pertains to variable potential electrokinetic devices useful as pumps and flow controllers.

Electrokinetic pumps are useful for pumping fluids in a highly controllable manner. In addition, electrokinetic pumps provide advantages over mechanical pumps because the electrokinetic pumps may be manufactured with few or no moving parts. U.S. Pat. Nos. 6,013,164 and 6,019,882 describe the manufacture and use of the first electrokinetic pumps capable of generating pressures in excess of a few pounds per square inch ("psi").

Electrokinetic flow controllers are useful for managing the flow of fluids through conduits and also have the advantage that they may be manufactured with few or no moving parts. U.S. patent application Ser. No. 09/942,884 assigned to Eksigent Technologies LLC describes the manufacture and use of the first electrokinetic flow controllers.

Notwithstanding these advantages, prior art electrokinetic pumps and flow controllers suffer from one or more shortcomings with respect to fluid composition, operating voltages, voltages at connection points to other devices, and pumping efficiencies that limit their use in many fluid handling applications.

U.S. Pat. No. 3,427,978 by Hanneman et al. discloses an electrohydraulic transducer designed to work with a purified, non-aqueous liquid having a hydrocarbon portion and a polar group and having a dielectric constant between 5 and 100. Furthermore, the devices taught by Hanneman et al. include in the pumping fluid a small amount of redox material so that the oxidation occurring at the anode balances the reduction occurring at the cathode thereby enabling the composition of the ionizing liquid to remain in an operationally stable condition over a period of a number of hours during the continuous application of an electrical potential difference of 200 volts and higher across the electrodes.

U.S. Pat. No. 6,171,067 to Parce provides a micropump that utilizes electroosmotic pumping of fluid in one conduit or region to generate a pressure based flow of material in a connected conduit, where the connected conduit has substantially no electroosmotic flow generated. The devices taught by Parce typically are fabricated using open microscale conduits, and include conduit wall surfaces that have associated charged functional groups to produce sufficient electroosmotic flow to generate requisite pressures in those conduits in which no electroosmotic flow is taking place. Parce also teaches that electroosmotic flow preferably is avoided in the first conduit portion either by providing the first conduit portion with substantially no net surface charge to propagate electroosmotic flow, or alternatively and preferably, electroosmotic flow is avoided in the first conduit portion by applying substantially no voltage gradient across the length of this conduit portion.

Takamura et al. ("Low-Voltage Electroosmosis Pump and Its Application to On-Chip Linear Stepping Pneumatic Pressure Source," in J. M. Ramsey and A. van den Berg (eds.), *Micro Total Analysis Systems* 2001, pp. 230-232 (2001) Kluwer Academic Publishers, the Netherlands)(which reference is not admitted by applicants to be prior art to the present invention) teach low-voltage electroosmotic flow pumps consisting of narrow conduits and cascade configuration microfabricated on quartz chips. Takamura et al. do not teach, as their FIG. 4 illustrates, how to design and build pumps capable of generating pressures more than about 80 mm $H_2O$ (0.1 psi) or 4 mm $H_2O$/volt (0.006 psi/volt), nor do they teach how to within broad limits arbitrarily set the potential at the inlet and outlet connection points of their electroosmotic pump.

The present invention addresses these and other shortcomings of the prior art by providing variable potential electroosmotic devices such as pumps capable of operation over a wide range of fluid composition and operating voltages, that can be fabricated as micro- or macro-scale devices, that are capable of generating considerably greater pressures/volt as compared to the prior art devices, and that can be configured for improved device safety and compatibility by allowing for the control of applied voltage at either or both of the ends of the devices. The present invention also provides improved geometries to enhance performance, safety and compatibility of electroosmotic flow controllers such as those described in co-owned U.S. patent application Ser. No. 09/942,884.

SUMMARY OF THE INVENTION

The present invention provides variable potential electrokinetic devices including pumps and flow controllers that have improved performance, safety, operating efficiency, and compatibility with other instrumentation. The present invention achieves these objectives by providing in a first aspect, a variable potential electrokinetic device that comprises a pumping conduit having a first end and a second end, and containing a porous dielectric material; a conducting conduit having a first end and a second end, said pumping conduit second end and said conducting conduit first end connecting at a junction; and an odd number of electrodes in electrical communication with the pumping conduit and the conducting conduit.

In a preferred embodiment, the odd number of electrodes comprises a first electrode at potential V1 in electrical communication with the pumping conduit first end; a second electrode at potential V2 in electrical communication with the junction; and a third electrode at potential V3 in electrical communication with the conducting conduit second end, wherein V1 does not equal V2.

In other preferred embodiments, V1 is equal to V3. This allows safety and compatibility to be optimized, by setting potentials V1 and V3 to, e.g., ground potential.

In another aspect, the invention provides for an electrokinetic device that comprises a pumping conduit having a first end and a second end, and containing a porous dielectric material; a conducting conduit having a first end and a second end, said pumping conduit second end and said conducting conduit first end connecting at a junction; and a first electrode at potential V1 in electrical communication with said pumping conduit first end, a second electrode at potential V2 in electrical communication with said junction, and a third electrode at potential V3 in electrical communication with said conducting conduit second end, wherein a predetermined electroosmotic flow may be generated by said device with at least one of said potentials V1 and V3 assuming an arbitrary value.

In another aspect, the invention provides a multi-stage electrokinetic device having a first pumping conduit having a first end and a second end, hydrodynamic conductance $k_p$, electrokinetic pressure value $p^{ek}_p$, and electrical resistance $R_p$ and containing a first porous dielectric material; a first conducting conduit having a first end and a second end, hydrodynamic conductance $k_c$, electrokinetic pressure value $p^{ek}_c$, and electrical resistance $R_c$, the first pumping conduit second end connecting to the first conducting conduit first end at a first junction; a second pumping conduit having a first end and a second end, and containing a second porous dielectric material, said first conducting conduit second end and said second pumping conduit first end connecting at a second junction; and a first electrode in electrical communication with said first pumping conduit first end; a second electrode in electrical communication with said first junction; a third electrode in electrical communication with said second junction; and a fourth electrode in electrical communication with said second pumping conduit second end, wherein $p^{ek}_c/p^{ek}_p<1$ is required, wherein $k_c>k_p$ is preferred to maximize performance and wherein $R_c>R_p$ is preferred to increase electrical efficiency and reduce electrochemical evolution of the pumping fluid. These design principles also may be applied to the single-stage variable potential electrokinetic devices to obtain similar advantages.

In a related aspect of the multi-stage electrokinetic device, the invention provides for the first electrode to be at potential V1, the second electrode to be at potential V2, the third electrode to be at potential V3, and the fourth electrode to be at potential V4, so that at least one of the differences (V1−V2) and (V1−V2) is not equal to zero. In another preferred embodiment, V1 is equal to V4. This allows safety and compatibility to be optimized, by setting potentials V1 and V4 to, e.g., ground potential.

In yet another aspect, the invention provides for a multi-stage electrokinetic device that includes a first pumping conduit having a first end and a second end, and containing a first porous dielectric material; a first conducting conduit having a first end and a second end, the first pumping conduit second end and the first conducting conduit first end connected at a first junction; a second pumping conduit having a first end and a second end, and containing a second porous dielectric material, the second pumping conduit first end connected to the first conducting conduit second end at a second junction; a second conducting conduit having a first end and a second end, the second pumping conduit second end connected to the second conducting conduit first end at a third junction; and an odd number of electrodes in electrical communication with the pumping conduits and the conducting conduits.

In a preferred embodiment of this multi-stage electrokinetic device, the odd number of electrodes comprises a first electrode at potential V1 in electrical communication with the first pumping conduit first end, a second electrode at potential V2 in electrical communication with the first junction, a third electrode at potential V3 in electrical communication with the second junction, a fourth electrode at potential V4 at the third junction, and a fifth electrode at potential V5 at the second conducting conduit second end, wherein at least one of the differences (V1−V2) and (V3−V4) does not equal zero. In another preferred embodiment, V1 is equal to V5. This allows safety and compatibility to be optimized, by setting potentials V1 and V5 to, e.g., ground potential.

In an alternative embodiment of the multi-stage electrokinetic device, the odd number of electrodes comprises a first electrode at potential V1 in electrical communication with said first pumping conduit first end, and an Nth electrode at potential VN in electrical communication with a second end of a terminal conducting conduit. In yet another preferred embodiment, V1 is equal to VN, which allows safety and compatibility to be optimized, by setting potentials V1 and VN to, e.g., ground potential.

In yet another embodiment, the invention provides for an electrokinetic device that comprises a first pumping conduit having a first end and a second end, and containing a first porous dielectric material a first conducting conduit having a first end and a second end, said first pumping conduit second end and said first conducting conduit first end connecting at a first junction; a second pumping conduit having a first end and a second end, and containing a second porous dielectric material, said second pumping conduit first end connecting to said first conducting conduit second end at a second junction; a second conducting conduit having a first end and a second end, said second pumping conduit second end connecting to said second conducting conduit first end at a third junction; and a first electrode at potential V1 in electrical communication with said first pumping conduit first end, a second electrode in electrical communication with said first junction, a third electrode in electrical communication with said second junction, a fourth electrode in electrical communication with said third junction, and a fifth electrode at potential V5 in electrical communication with said second conducting conduit second end, wherein a predetermined electroosmotic flow may be generated by said device with at least one of said potentials V1 and V5 assuming an arbitrary value.

The invention also provides for methods of using the devices to control the flow of a fluid. In one aspect, the invention thus provides a method of controlling the flow of a fluid by contacting a pumping conduit first end with a fluid; and supplying potential V1 to a first electrode in electrical communication with the pumping conduit first end, potential V2 to a second electrode in electrical communication with the junction and potential V3 to a third electrode in electrical communication with the conducting conduit second end.

In another aspect, the invention provides a method of controlling the flow of a fluid by supplying a pressure-driven flow to said pumping conduit, and modulating said pressure-driven flow by an electroosmotically-driven flow component generated within said pumping conduit.

Other aspects include a method of controlling the flow of a fluid by contacting at least one end of said first pumping conduit or said second pumping conduit of an electrokinetic device of the invention with a fluid; and supplying potential V1 to a first electrode in electrical communication with said first pumping conduit first end, potential V2 to a second electrode in electrical communication with said first junction, potential V3 to a third electrode in electrical communication with said second junction, potential V4 to a fourth electrode in electrical communication with said third junction, and potential V5 to said second conducting conduit second end.

Yet another aspect of the invention provides a method of controlling the flow of a fluid by supplying a pressure-driven flow to a multi-stage electrokinetic device, and modulating said pressure-driven flow by an electroosmotically-driven flow component generated within said first or said second pumping conduit.

The principles and operation of the invention will now be described by reference to the following figures, which are intended to serve as illustrative embodiments but not to limit the scope of the invention.

DETAILED DESCRIPTION OF PREFERRED EMBODIMENTS

Definitions

Figure 1:
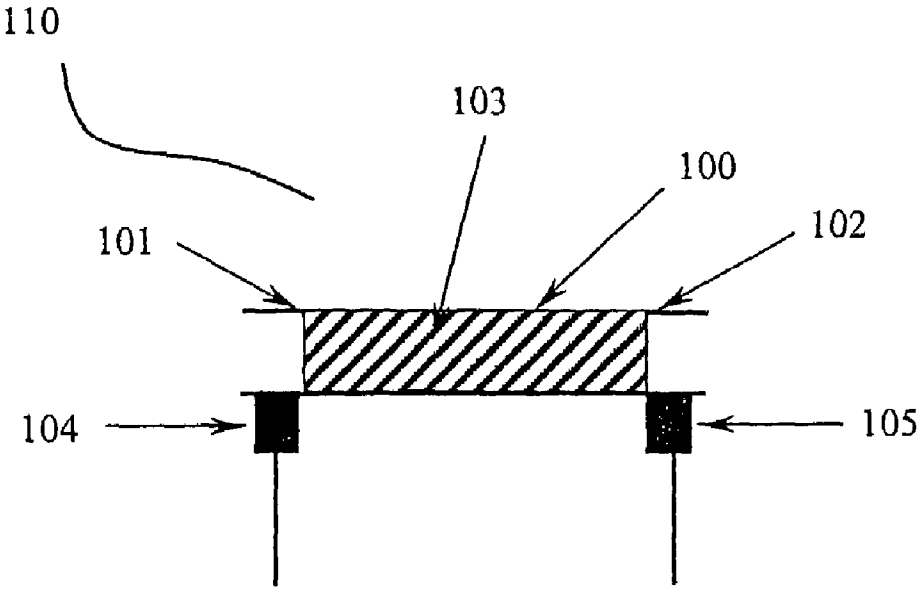
FIG. 1 illustrates a prior art electrokinetic pump and associated electrical connections.

Unless otherwise indicated, all terms used in this specification are to be construed according to their ordinary meaning, as understood by those of skill in the art. In case of conflict between definitions provided in this specification and the ordinary meaning, the definitions provided in the specification shall control.

The term "porous dielectric material" refers to an electrically non-conducting material through which a fluid can flow and which, when contacted with a fluid is capable of generating a zeta potential.

The term "zeta potential" refers to the potential that exists in solution at a specified distance from a charged surface. The zeta potential arises because a net charge at a solid surface affects the distribution of ions in the surrounding interfacial region, resulting in an increased concentration of counter ions (i.e., ions bearing a charge opposite that of the surface charge) close to the surface. The liquid layer near the surface exists as two parts; an inner region (Stem layer) where the ions are strongly bound and an outer (diffuse) region where they are less firmly associated. These two layers are referred to as an electrical double layer. Within the diffuse layer is a notional boundary known as the shear plane. The potential at this boundary is known as the zeta potential. Zeta potentials may be determined using commercially available instruments (such as the ZetaPals available from Brookhaven Instruments Corporation, Holtsville, N.Y.).

The term "conduit" refers to a physical construction that has an input face and an output face the remaining sides being impermeable to flow and/or current. The conduit is composed of an electrically insulating material. Thus current and flow-rate are conserved through a conduit. The length, L, of a conduit is a distance between the input and output faces as measured along the mean flow and/or current streamline. The facial areas of the conduit are the geometric surface area of the input and output faces through which the current and/or liquid may flow. The effective area of a conduit is given by $A=LF/R\sigma$. Here R is the electrical resistance of the conduit saturated with a fluid of bulk conductivity $\sigma$ and F is the formation factor of any porous media within the conduit. The actual cross sectional area (wetted area perpendicular to the length axis) may be of any shape and the value of the area and/or the shape may vary arbitrarily along the length of a conduit. A conduit may or may not contain a porous material in whole or in part. The type or characteristics of this porous material need not be uniform through the conduit. A conduit bounds a fluid path. A conduit may bound and retain a porous media.

The term "an end" refers to a specified region of an object that may or may not coincide with a terminus of the object.

The term "second end of a terminal conducting conduit" refers to an end of a conducting conduit through which the electrokinetic device is connected to another device or fluid reservoir.

The term "junction" refers to a region at which two or more elements connect.

The term "electrode" refers to an electrically conducting material, or a point within an electrically conducting material, through which current can flow between a source of electrical potential and a region of a device in electrical communication with the electrode. Thus, multiple electrodes may be present in a single piece of an electrically conducting material, if said material makes electrical contacts with multiple regions of a device.

The term "in electrical communication with" refers to the existence of a path for current flow between two or more objects that are said to be in electrical communication with each other.

The term "hydrodynamic conductance" (indicated by the variable "k") refers to the ease with which fluid is able to flow through a flow element, and is mathematically defined as $k=k_dA/L$, where $k_d$ is the Darcy permeability of the porous media divided by the dynamic viscosity of the liquid, A is the effective area of a conduit, as defined above, and L is the length of the element. The hydrodynamic conductance can be determined by measuring the flow rate through an element for a given driving pressure differential or by any other of the methods that are well known to those of skill in the art.

The term "electrokinetic pressure value" (indicated by the variable "$p^{ek}$") refers to the maximum pressure differential that can be generated electrokinetically by applying a given voltage differential to an electroosmotic flow element. Mathematically, $p^{ek}$ may be expressed as $p^{ek}=|\Delta V(\nu/\kappa)|$, where $\Delta V$ is the electric potential applied across the flow element, $\kappa$ is the Darcy permeability of the porous media divided by the dynamic viscosity of the liquid (as above) and multiplied by the formation factor, F (described later), and $\nu$ is the effective electroosmotic mobility. The ratio $\nu/\kappa$ represents the amount of pressure generated per volt applied across the flow element, is a property of the electrolyte-filled porous medium, and therefore is independent of the geometry of the element (i.e., the cross-sectional area and length). The value of $p^{ek}$ can be determined from the experimental measurements of ν, κ, and ΔV, or ν/κ can be determined by a measurement of the pressure generated by a single section of the electroosmotic flow element with a given applied voltage difference.

The term "electrical resistance" (indicated by the variable "R") refers to the resistance of a material to the flow of current and is defined, according to Ohm's law as R=ΔV/I, where ΔV is a voltage difference applied across the ends of a material (e.g., a pumping conduit or a conducting conduit), and I is the amount of current that flows through the material in response to the applied voltage difference. Electrical resistance is conveniently measured by an ohm meter or conductivity meter.

The phrase "with at least one of said potentials $V_x$ and $V_y$ assuming an arbitrary value" refers to the ability of a device within the scope of the instant invention to be operated with either or both of said voltages $V_x$ and $V_y$ set to any one of a number of potentials, including ground potential. Usually, these potentials will be selected by the user so as to improve the safety of the devices of the present invention, as well as their compatibility with other devices. In certain embodiments, $V_x$ and $V_y$ may assume different values, whereas in other embodiments, the value of $V_x$ and $V_y$ will be the same. It is intended that the phrase "with at least one of said potentials $V_x$ and $V_y$ assuming an arbitrary value" be read to cover devices in which either or both of the potentials $V_x$ and $V_y$ may be set by the user, as well as devices in which either or both of the potentials $V_x$ and $V_y$ are not user-selectable parameters. The phrase is thus intended to cover devices in which a performance parameter of the device (e.g., flow or pressure) may be changed without requiring a change in the values of either or both of $V_x$ and $V_y$.

The phrase "microscale" is intended to refer to devices having conduits with effective diameters on the order of millimeters or less, while the phrase "macroscale" is intended to refer to devices having conduits with effective diameters larger than those of "microscale" devices.

Variable Potential Electrokinetic Devices

The variable potential electrokinetic devices of the present invention provide improvements to prior art electrokinetic pumps and flow controllers that use porous dielectric materials as pumping media. Through the use of new geometries, the variable potential electrokinetic pumps and flow controllers of the present invention increase the flexibility and capabilities of prior art devices. Unlike previous electrokinetic pumping and flow controlling systems, the present invention permits control of the electrical potential at the inlet and outlet of the device while substantially maintaining performance. In a preferred embodiment, the inlet and outlet ends of an electrokinetic device according to the present invention can be set to ground to protect the user and other system components against exposure to high voltage.

The present invention also provides for multi-stage variable potential electrokinetic pumps that can function as electrokinetic pressure amplifiers. Amplification is accomplished by the serial connection of pumps to effectively generate higher pressure differentials per applied voltage difference for a specific porous material than that which has been described for prior art devices. Single and multi-stage variable potential electrokinetic pumps may be used for any application to which electrokinetic pumps or mechanical pumps may be put. These include both microfluidics and macrofluidic applications (flow rates ranging from picoliters/minute to milliliters/minute or more). An additional application of the multi-stage variable potential electrokinetic devices is in flow-controller applications such those set forth in co-pending and co-owned U.S. patent application Ser. No. 09/942,884.

The basic configuration of a prior art electrokinetic device is illustrated in FIG. 1. The device, 110, comprises a pumping conduit, 100, containing a porous dielectric material, 103. Each end, 101, and 102, of the pumping conduit, 100, is in electrical communication with an electrode, 104, and 105, that is used to apply a voltage across the section of the pumping conduit 100, that contains the porous dielectric material, 103. Achieving high-pressure generation or controlling the rate of a pressurized flow using prior art electrokinetic devices requires careful tradeoffs among the characteristics of the pumping material (such as its surface charge and pore size) and the applied voltage. For many tested materials, kilovolts of applied voltage are necessary to obtain the high pressures, e.g., pressures on the order of $10^3$ psi, routinely used in applications such as high performance liquid chromatography ("HPLC").

Because a voltage gradient is used to drive electrokinetic devices, the format employed in prior art devices requires that at least one end of the device, i.e., the inlet, 101, or the outlet, 102, be maintained at a voltage other than earth ground. As described below, the variable potential devices of the present invention provide one solution to these problems.

Application of high voltage at one end of the device creates potential safety problems for the user, and also may cause electrical interference, crosstalk, or damage to other system components connected to the device. The need for high-voltage power sources and connections to electrokinetic devices also produces a greater demand on the system components by requiring, e.g., the use of high-voltage-rated components and insulating materials, typically increasing system cost while decreasing manufacturing flexibility. Furthermore, high-voltage power sources typically do not have high energy efficiencies, and therefore decrease the overall power efficiency of any device into which they are incorporated. The multi-stage electrokinetic devices of the present invention, discussed below, permit the use of considerably lower driving voltages and so address these shortcomings of prior art electrokinetic pumps and flow controllers.

Figure 2A:
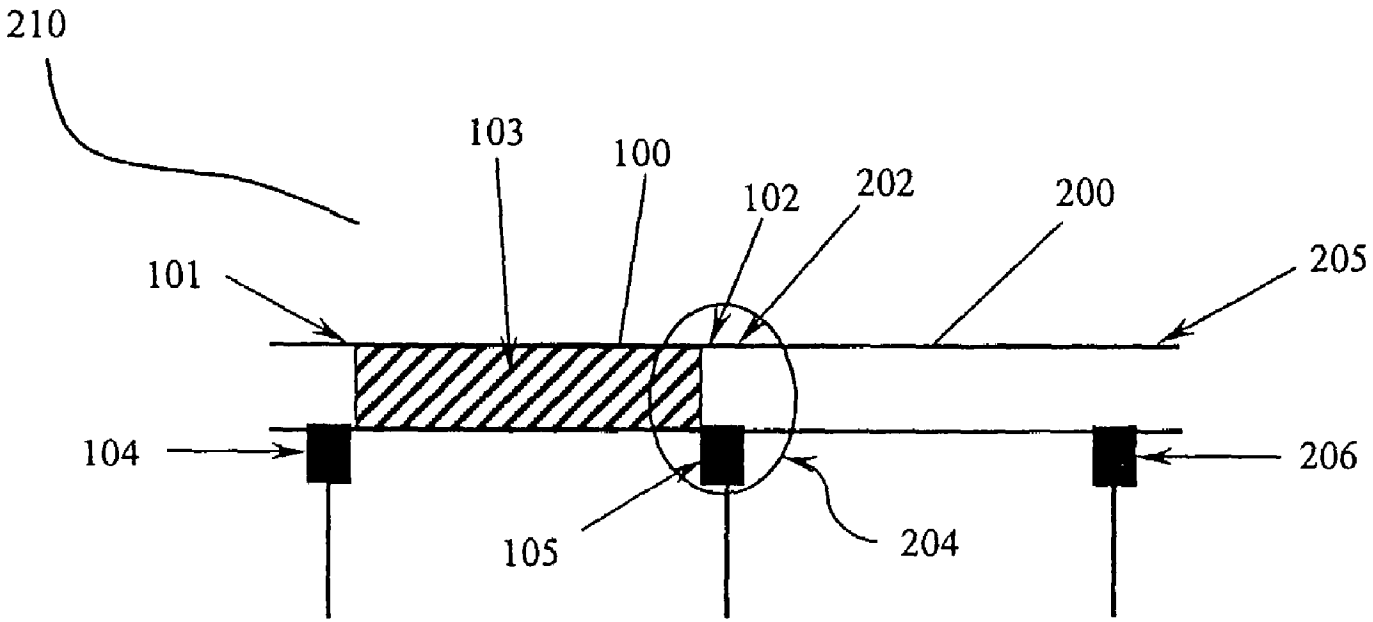
FIG. 2*a* illustrates a first embodiment of a variable potential electrokinetic device.

A diagram of the variable potential electrokinetic device of the present invention is shown in FIG. 2*a*. The device, 210, comprises a pumping conduit, 100, that contains a porous dielectric material, 103. One end, 101, of the pumping conduit, 100, is in electrical communication with an electrode, 104. The other end, 102, of the pumping conduit, 100, is connected to an end, 202, of a conducting conduit, 200. The region at which the connection is made is referred to as a junction, 204. The junction region, 204, also contains an electrode, 105, that is in electrical communication with an end of the pumping conduit 102, and an end of the conducting conduit 202. Another electrode, 206, is in electrical communication with a second end, 205, of conducting conduit, 200.

A voltage gradient is applied to the porous dielectric material, 103, within the pumping conduit, 100, by applying different voltages e.g., V1 and V2≠V1 to electrodes 104 and 105. The voltage gradient is used to control the force applied to a fluid within the pumping conduit, 100, and, for a given length of pumping conduit, 100, is determined by the difference between the two voltages.

As necessary, the gradient may be positively or negatively signed, depending on the sign of the zeta potential and the direction in which fluid is to be pumped. Since device performance depends on the voltage difference, one can arbitrarily set one voltage (e.g., grounding voltage at electrode 104) and adjust the other voltage (e.g., the junction voltage at electrode 105) to yield the desired gradient.

A key feature of the present invention is illustrated in FIG. 2*a*, which illustrates the addition to the basic electrokinetic pump, 110, shown in FIG. 1 of a conducting conduit, 200. The conducting conduit, 200, is joined to the pumping conduit, 100, at a junction, 204, so that an end of the pumping conduit, 102, is connected to an end of the conducting conduit, 202. A second end, 205, of conducting conduit, 200, is in electrical communication with electrode, 206, set at voltage V3. It has been unexpectedly discovered that within broad limits, this third voltage can be arbitrarily defined.

The flexibility of the present invention allows for electrodes 104 and 206 to be at two different voltages. Device output may be controlled by adjusting the voltage at electrode 105. This configuration is especially useful in circumstances where other components of the overall system (i.e., components upstream and/or downstream of the device) require specific voltages for safe and effective operation.

In general, a voltage gradient will be created across the conducting conduit, 200, that will produce electrical conduction through the fluid in the conducting conduit, 200, and possibly induce electroosmotic flow in the conducting conduit. In certain embodiments of the invention, the conducting conduit, 200, may be an open conduit, i.e., a conduit that is not filled with a material other than the pumped fluid when the pump is in operation. In other embodiments, the conducting conduit, 200 may contain a porous material that may or may not generate a zeta potential when contacted with the pumped fluid. Electroosmotic flow may be induced in the conducting conduit, 200, if, when contacted with a pumped fluid, the walls of the conduit have a surface charge or a porous material filling the conducting conduit generates a zeta potential. Although the conducting conduit, 200, is not typically required to generate electroosmotic flow, it is permissible to have the conducting conduit generate electroosmotic flow (e.g., with a zeta potential of either the same or opposite sign relative to the porous media in the pumping conduit) if the electrokinetic pressure value for the conducting-conduit is smaller than that of the pumping medium. Thus, so long as the electrokinetic pressure value, $p^{ek}_c$, of the conducting conduit, 200, is less than the electrokinetic pressure value, $p^{ek}_p$, of the pumping conduit, 100, the pressure generated by the porous dielectric material, 103, will dominate the overall pressure generated through the variable potential electrokinetic pump, 210. The value of $p^{ek}$ can be determined from the experimental measurements of $\nu$, $\kappa$, and $\Delta V$ or $\nu/\kappa$ can be determined by a measurement of the pressure generated by a single section of the electroosmotic flow element with a given applied voltage, as described above. Mathematically, the condition for this preferred embodiment may be expressed as $p^{ek}_c/p^{ek}_p<1$, where $p^{ek}_c$ is the effective flow resistance of the conducting conduit, and $p^{ek}_p$ is the effective flow resistance of the pumping conduit. The lower this effective flow resistance ratio, the more effective the device will be at generating flow at pressure (pumping mode of operation) or controlling a pressurized flow (flow controller mode of operation). In other preferred embodiments, $p^{ek}_c/p^{ek}_p \leqq 0.5$, $p^{ek}_c/p^{ek}_p \leqq 0.1$, or $p^{ek}_c/p^{ek}_p \leqq 0.01$, or $p^{ek}_c/p^{ek}_p \leqq 0.001$, or $p^{ek}_c/p^{ek}_p \leqq 0.0001$. The optimized ratio of $p^{ek}_c/p^{ek}_p$ can be achieved by controlling the pore size, pore size distribution and, or zeta potential of the pumping and conducting conduits. The preferred embodiments will tend toward smaller pores or higher zeta potentials in the pumping conduit relative to the pores and zeta potential that optionally may be present in the conducting conduit. Since flow through the largest pores can dominate transport, a narrow distribution of pore size is desirable. The preferred embodiments will have a large absolute value of zeta potential in the pumping conduit and also have no zeta potential in the conducting conduit or a zeta potential in the conducting conduit that minimizes the pressure reduction in the desired direction. Note that the ratio of $p^{ek}_c/p^{ek}_p$ goes to zero as the zeta potential of the conducting conduit goes to zero. It should be noted that $p^{ek}_c/p^{ek}_p$ is independent of cross-sectional area and length.

Figure 2B:
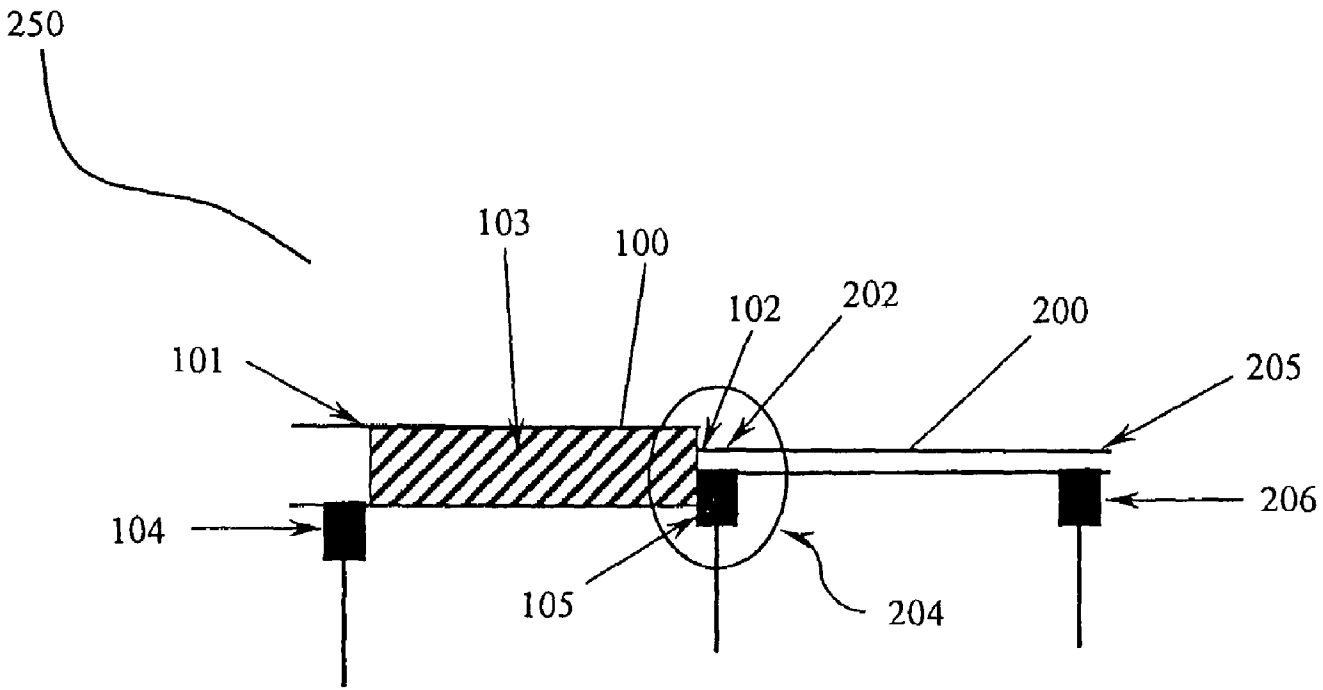
FIG. 2*b* illustrates a second embodiment of a variable potential electrokinetic device.

Performance of the variable potential electrokinetic devices of the present invention also may be optimized to minimize the current flow and the flow resistance across the conducting conduit, 200. An embodiment of an optimized configuration is illustrated in FIG. 2*b*. Consider, e.g., a pumping conduit, 100, constructed using a capillary of inner diameter 150 μm packed with 1 μm diameter silica beads as the porous dielectric material, 103, and an open conducting conduit, 200, of equal length and inner diameter of 10 μm. This configuration results in a ratio of $k_c/k_p \sim 25$, where $k_c$ is the hydrodynamic conductance of the conducting conduit, and $k_p$ is the hydrodynamic conductance of the pumping conduit and a ratio of $R_c/R_p \sim 50$, where $R_c$ is the electrical resistance of the conducting conduit, and $R_p$ is the electrical resistance of the pumping conduit. Other preferred embodiments include geometries and configurations in which $k_c/k_p \geqq 10$, or $k_c/k_p \geqq 100$, $k_c/k_p \geqq 1000$, or $k_c/k_p \geqq 10{,}000$.

Desired ranges of $k_c/k_p$ ratios may be obtained by varying the length and cross sectional areas of the conducting and pumping conduits, and optionally, by choice of the effective pore size of the porous material for embodiments in which the conducting conduit, 200, is filled. The preferred embodiments will tend toward increasing the ratio of $k_c/k_p$ through the use of small pores in the pumping conduit relative to the pores that optionally may be present in the conducting conduit.

In other preferred embodiments, $R_c/R_p \geqq 1$, or $R_c/R_p \geqq 2$, or $R_c/R_p \geqq 5$, or $R_c/R_p \geqq 10$, or $R_c/R_p \geqq 100$. These embodiments tend to minimize current draw by the conducting conduit and so possess improved operating efficiencies with respect to pressures or flows generated per unit energy consumed as compared to less preferred embodiments. Desired ranges of $R_c/R_p$ may be obtained by varying the length and cross-sectional areas of the pumping and conducting conduits, and through selection of materials for filling the pumping and optionally, the conducting conduits. Simultaneous optimization of the $k_c/k_p$ and $R_c/R_p$ ratios requires a compromise between lengths and areas of the pumping and conducting conduits. The preferred embodiments will reduce the area and increase the length of the conducting conduit to reduce current in this element. The resulting reduction in $k_c/k_p$ then is compensated by minimizing the pore size in the pumping conduit.

Figure 2C:
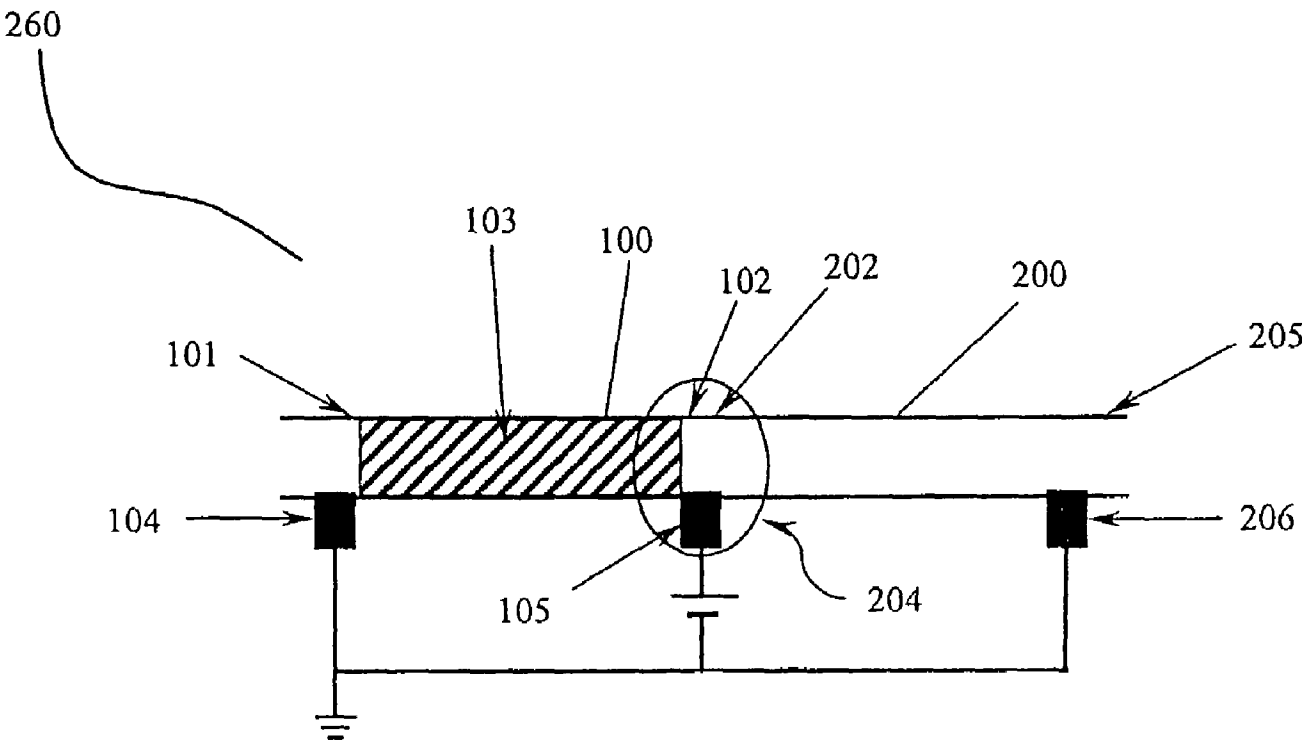
FIGS. 2*c* and 2*d* illustrate two alternative embodiments of a variable potential electrokinetic device.
Figure 2D:
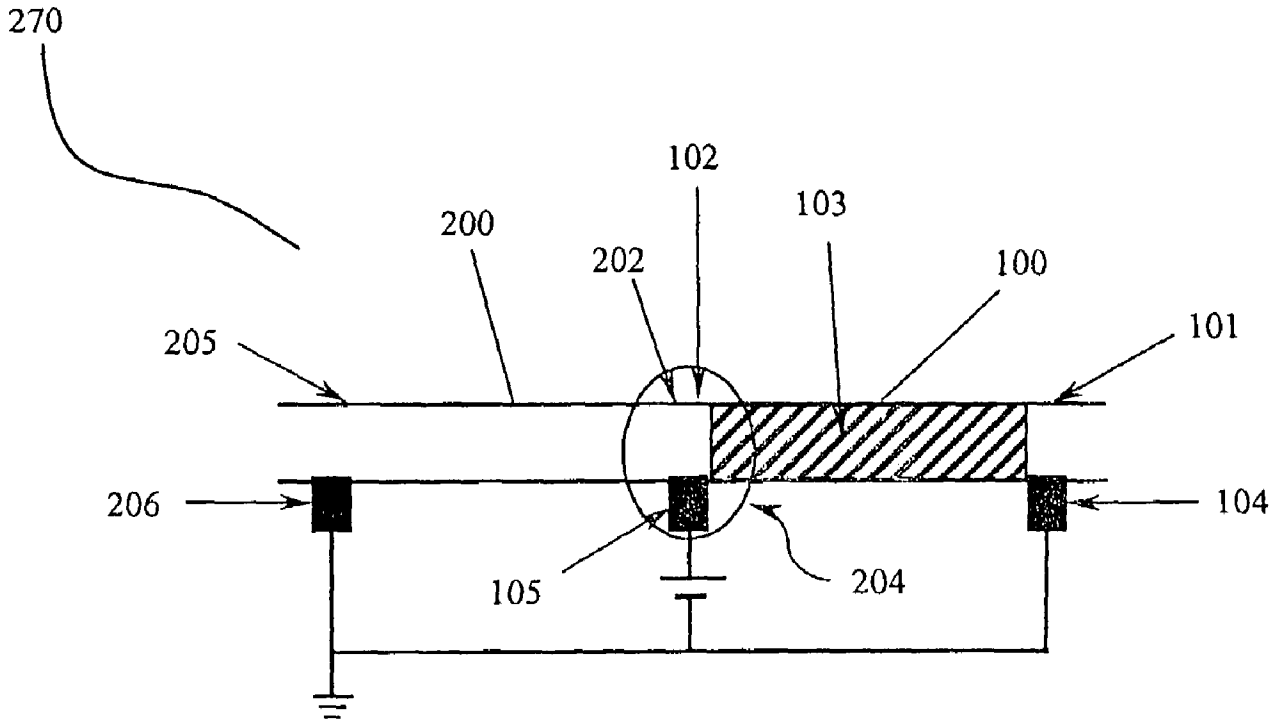

The variable potential electrokinetic devices of the present invention improve the safety and versatility of electrokinetic pumps and flow controllers. These advantages are illustrated in FIGS. 2*c* and 2*d*. FIGS. 2*c* and 2*d* illustrate alternate embodiments in which the positions of the pumping conduit 100, and conducting conduit, 200, are transposed. FIGS. 2*c* and 2*d* illustrates examples of variable potential electrokinetic devices, 260 and 270, in which the electrodes 104 and 206, respectively located at an end, 101, of the pumping conduit, 100, and at an end, 205, of conducting conduit, 200, both are set to electrical ground potential. The electrode, 105, located at the junction, 204, between end 102, of pumping conduit, 100, and end 202, of conducting conduit, 200, is set to a potential other than ground to generate force on the fluid within pumping conduit, 100. Because the potential at electrodes 104 and 206 is set to electrical ground, the user is not exposed to the driving voltage (i.e., the potential at electrode 105, often many kilovolts) of the pump. Further, system components connected to a "grounded device" need not be tolerant of the applied driving voltage at electrode 105.

For example, a variable potential electrokinetic device configured as in FIG. 2*c* or 2*d* so as to set to ground the potentials at electrodes 104 and 206 may be connected to a system component (upstream or downstream of the device) that can be made of a conducting material such as metal without concern that current will flow from the ends of the device in electrical communication with electrode 104 or 206 to the system component, provided, of course, that the system component, if made of a conducting material, is set to the same potential as electrode 104 or 206. Conveniently, this condition may be met by connecting electrodes 104 or 206 and a conducting material system component to a common ground. Thus, the variable potential electrokinetic devices of the present invention may be used to avoid or prevent voltage breakdown and arcing caused by high voltages in proximity to other system components. Also, stray voltages, fields, and derived currents from the device that could have a deleterious impact on other components of the system (e.g., electronics, sensors, detectors, fluid streams, etc.) are avoided using a configuration such as that illustrated in FIG. 2*c* or 2*d*.

It is well-known to one of skill in the art that application of an electrical potential to a fluid via electrodes 104, 105, and 206 in communication with that fluid can generate a current through the fluid, and that gas may be generated at the electrodes 104, 105, and 206 via electrolysis of the fluid. It is further appreciated that gas generation within a closed fluid conduit may be undesirable. Thus, a bridge may be used to connect electrodes 104, 105, and 206 in fluid-filled reservoirs to fluid in the conduit 100. Such bridges are well-known in the art, and are described, for example, in C. Desiderio, S. Fanali and P. Bocek, 'A new electrode chamber for stable performance in capillary electrophoresis,' Electrophoresis 20, 525-528 (1999), and generally comprise a porous membrane or porous solid selected to have sufficiently small pores so as to minimize fluid flow through the bridge, while at the same time to provide for the transport of ions (i.e. to allow current flow). Typical bridge materials include Nafion™ (an ion-selective polymeric membrane) or porous Vycor™ (a phase-separated and etched porous glass having a pore size on the order of 5 nm).

Electrokinetic Multipliers

Figure 3:
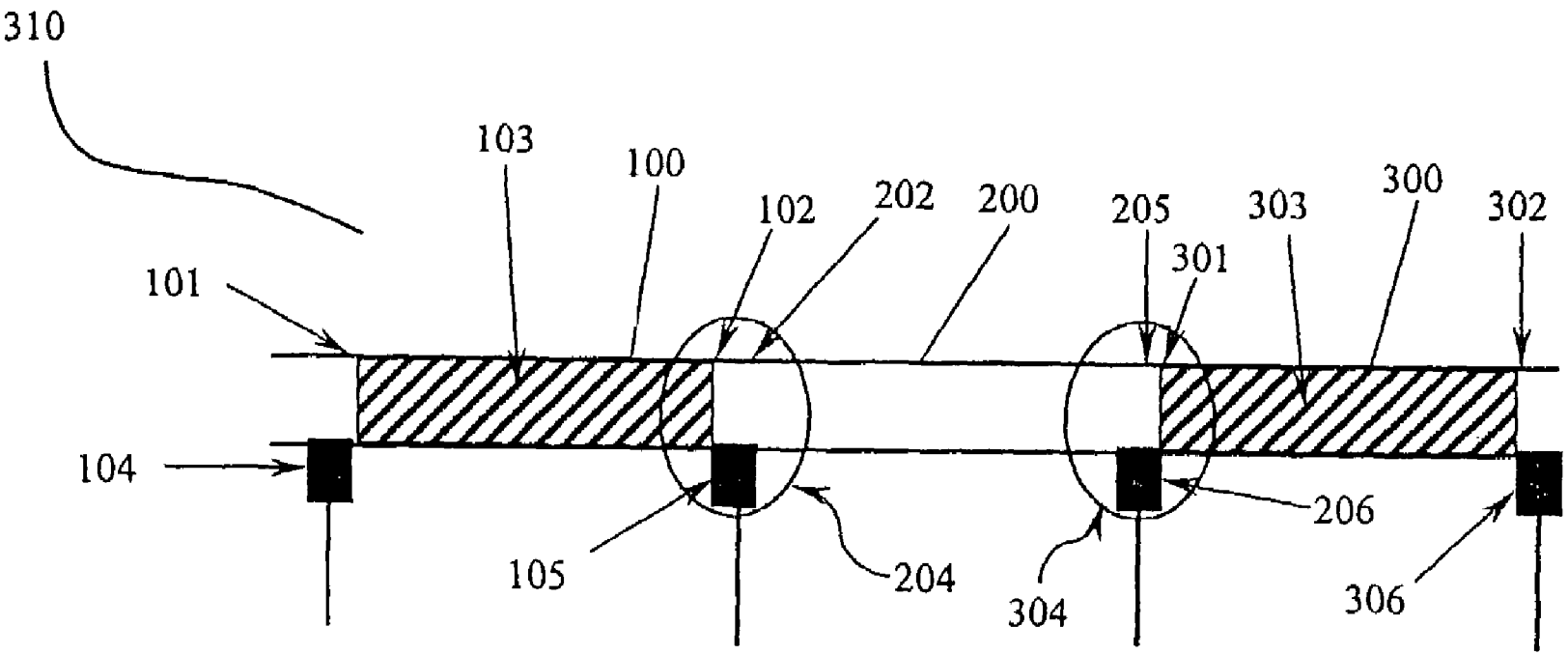
FIG. 3 illustrates a two-stage, four electrode variable potential electrokinetic device.

The variable potential electrokinetic devices of the present invention may be serially coupled into electrokinetic pressure multipliers or enhanced-performance flow controllers that achieve further advantages as described below. A simple example of this coupling is shown in FIG. 3, that illustrates one embodiment of a coupled variable potential electrokinetic device, 310. The device includes two pumping conduits, 100, and 300, connected in series via a conducting conduit, 200. As is the case with the variable potential electrokinetic devices illustrated in FIGS. 2*a*-2*d*, the pumping conduits contain a porous dielectric material, 103, 303, that may be used to generate an electroosmotic force on a pumping or transport fluid. The porous dielectric materials, 103, 303, may be the same as, or different from, each other. Consider, for the sake of illustration, end, 101, of pumping conduit, 100, to be the device inlet. Of course, depending on the signs of the zeta potential and the applied voltages, end, 101, also could be the device outlet. The coupled device, 310, includes: electrode, 104, in electrical communication with the region of the device inlet, 101; electrode, 105, in electrical communication with a first junction region, 204, that includes end, 102, of pumping conduit, 100, end, 202, of conducting conduit, 200, and electrode, 105; electrode 206, in electrical communication with a second junction region, 304, that includes end, 205, of conducting conduit, 200, end, 301, of pumping conduit 300, and electrode 206; and electrode, 306, in electrical communication with end, 302, of pumping conduit, 300 (which in this illustration, corresponds to the device outlet).

In this illustrated embodiment, two pumping conduits (100, 300) are coupled in series. This configuration allows one to increase the overall pressure generated by the multiple pump system for a given voltage applied to each pumping conduit, as the pressure generated in the first pumping conduit, 100, is, in effect, amplified, by the second pumping conduit, 300. This flexibility allows one to potentially go to very low voltages to drive high-pressure pumps. Coupled pumps permit the voltage for generating a desired pressure or flow to be distributed over multiple pumping conduits, thus lowering the voltage applied to any given pumping conduit as compared with the voltage used to generate that pressure or flow using a single pumping conduit. In a similar fashion, the coupling of pumping conduits in series allows flow controllers to more efficiently control flow at higher pressures.

As the required voltage is reduced, advantages are achieved by allowing greater flexibility and potentially lower cost in designing the system for supplying the voltages (e.g., power supplies, cables, switches). In an electrokinetic multiplier it is not necessary to apply a constant voltage to all pumping conduits simultaneously. While constant voltage may produce the highest pressures, it may be desirable to apply voltages to staggered subunits and cycle between groups of subunits. This allows a constant voltage source to provide variable flow rates through the device, whether the device is used in a pumping or a flow-control mode.

As one example, one could control pressure generation of a multiple pump system by selecting a number of pumping conduits within the electrokinetic multiplier and driving that number at a relatively low, fixed voltage. This mode of pressure or flow control permits simple and inexpensive control electronics to be used. Alternatively, pressure or flow control can be achieved by varying the potential applied to one or more pumping conduits. In general, the amplified pumps allow greater flexibility in applying voltages, and this flexibility reduces the demands of other pump components such as the pumping material.

Figure 4:
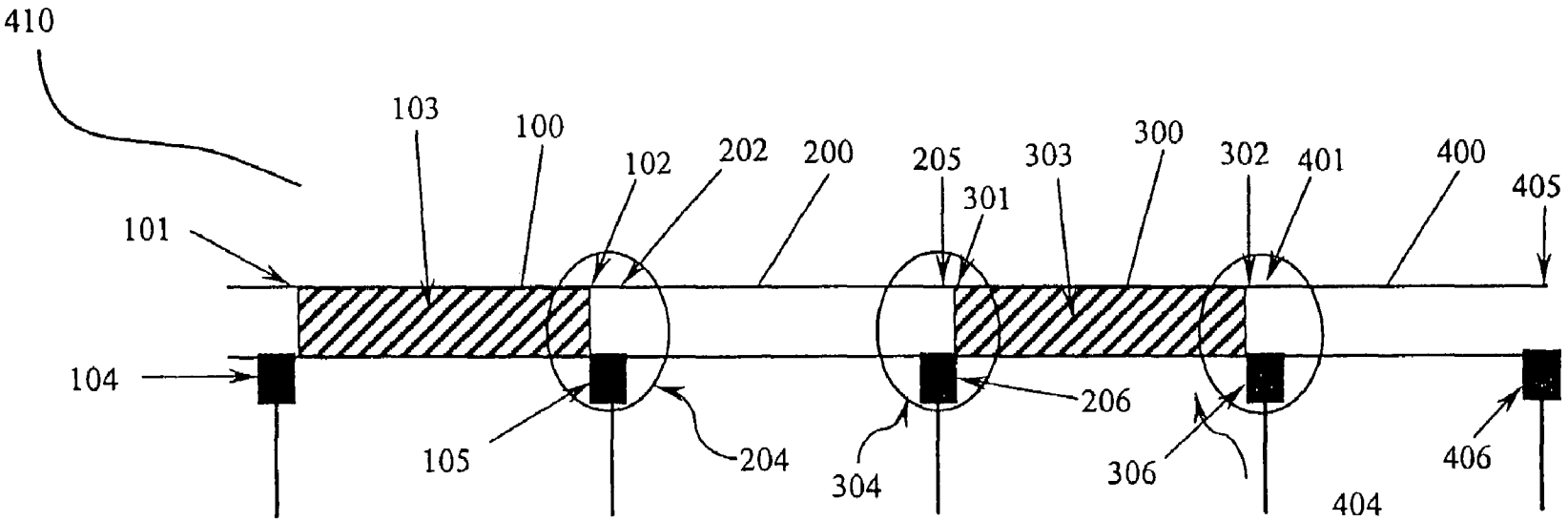
FIG. 4 illustrates a two-stage, five electrode variable potential electrokinetic device.

An alternative embodiment of the electrokinetic multiplier is illustrated in FIG. 4. The embodiment of FIG. 4, 410, adds to the embodiment illustrated in FIG. 3 an additional conducting conduit, 400, and an additional electrode, 406, in electrical communication with end, 405, of conducting conduit, 400. In the embodiment of FIG. 4, electrode, 306, is in electrical communication with a third junction region, 404, that includes end, 302, of pumping conduit, 300, end, 401, of conducting conduit, 400, and electrode, 306. This embodiment permits electrodes 104 and 406 to be set to essentially any arbitrary voltages, including ground, thus further increasing the flexibility and safety of the electrokinetic pressure multiplier according to the advantages associated with avoiding high-voltage connections at the device inlet or outlet.

The embodiments of FIGS. 3 and 4 illustrate electrokinetic multipliers that contain two pumping conduits or pumping stages (100, 300), and a single (200), or two conducting conduits (200, 400), respectively. These embodiments may be generalized to "N-stage" devices having 2N, or 2N+1 electrode; these generalized embodiments are respectively illustrated in FIG. 5 (N-stage, 2N electrode) and FIG. 6 (N-stage, 2N+1 electrode).

Figure 5:
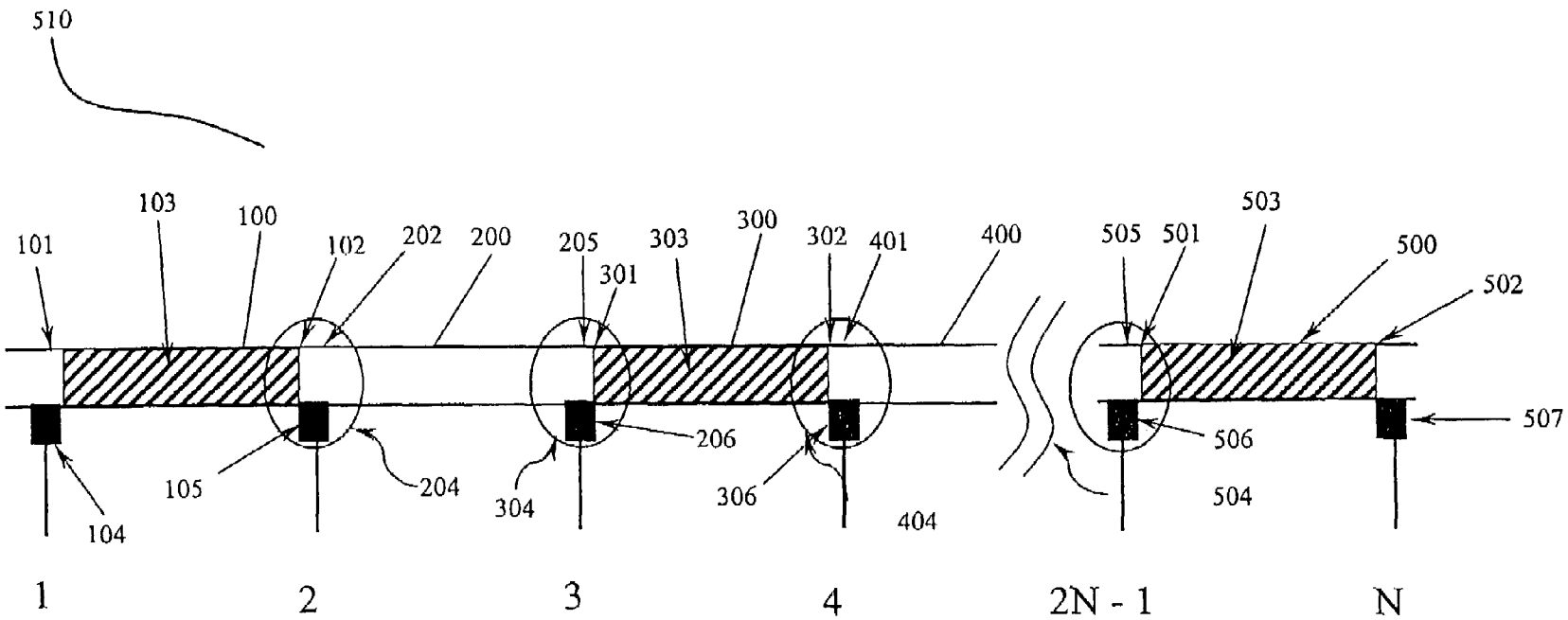
FIG. 5 illustrates an N-stage, 2N electrode variable potential electrokinetic device.

The N-stage, 2N electrode electrokinetic multiplier of FIG. 5, 510, recapitulates the elements illustrated in the 2-stage, 4 electrode electrokinetic multiplier, 310, of FIG. 3, and adds to that embodiment, following the discontinuity marks, the "Nth" pumping conduit or stage, 500, containing a porous dielectric material, 503; the 2N−1 electrode, 506, in electrical communication with a junction region 504, that contains an end, 505, of the N−1 conducting conduit (not shown), an end 501, of the Nth pumping conduit, 504, and electrode, 506; and the 2N electrode, 507, in electrical communication with end, 502, of the Nth pumping conduit, 500.

Figure 6:
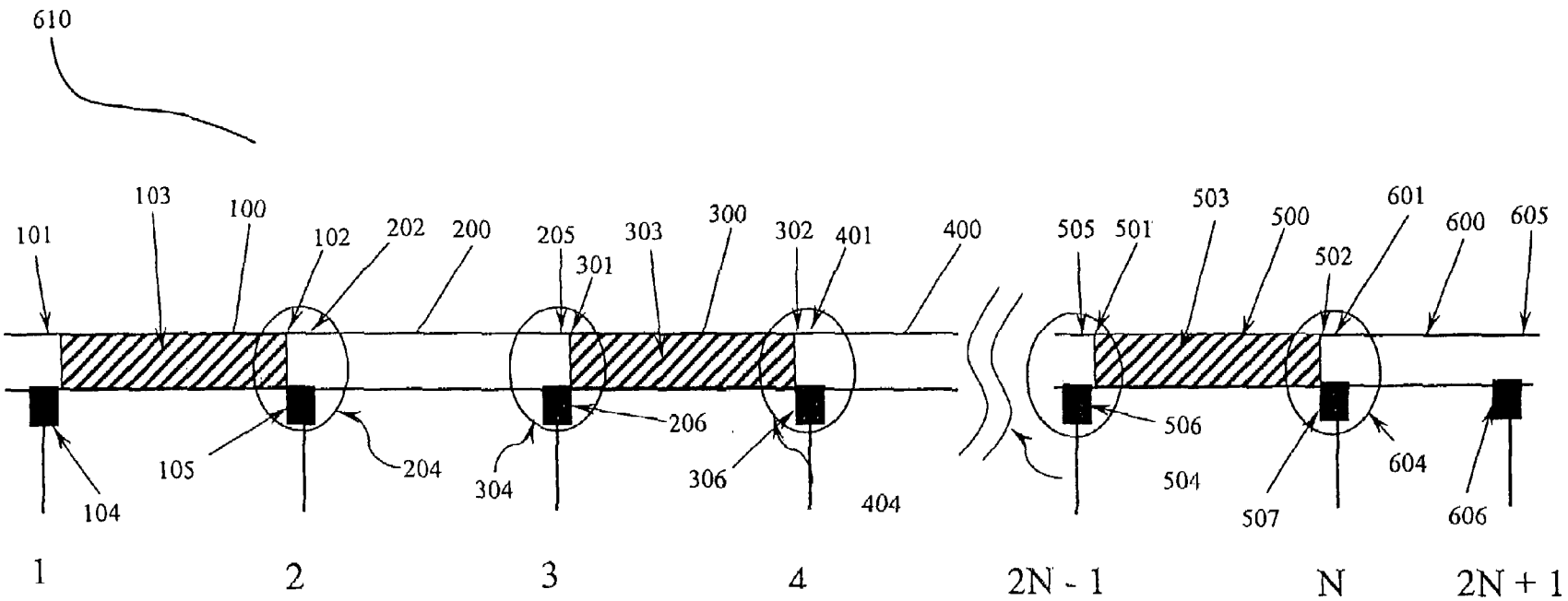
FIG. 6 illustrates an N-stage, 2N+1 electrode variable potential electrokinetic device.

Similarly, the N-stage, 2N+1 electrode electrokinetic multiplier of FIG. 6, 610, recapitulates the elements illustrated in the 2-stage, 5 electrode electrokinetic multiplier, 410, of FIG. 4, and adds to that embodiment, following the discontinuity marks, the "Nth" pumping conduit or stage, 500, containing a porous dielectric material, 503; the 2N−1 electrode, 506, in electrical communication with a junction region 504, that contains an end, 505, of the N−1 conducting conduit (not shown), an end 501, of the Nth pumping conduit, 504, and electrode, 506; 2N electrode, 507, in electrical communication with junction region, 604, that contains an end, 502, of the Nth pumping conduit, 500, an end, 601, of the Nth conducting conduit, 600, and electrode, 507; and 2N+1 electrode, 606, in electrical communication with end, 605, of the Nth conducting conduit, 600.

Figure 7:
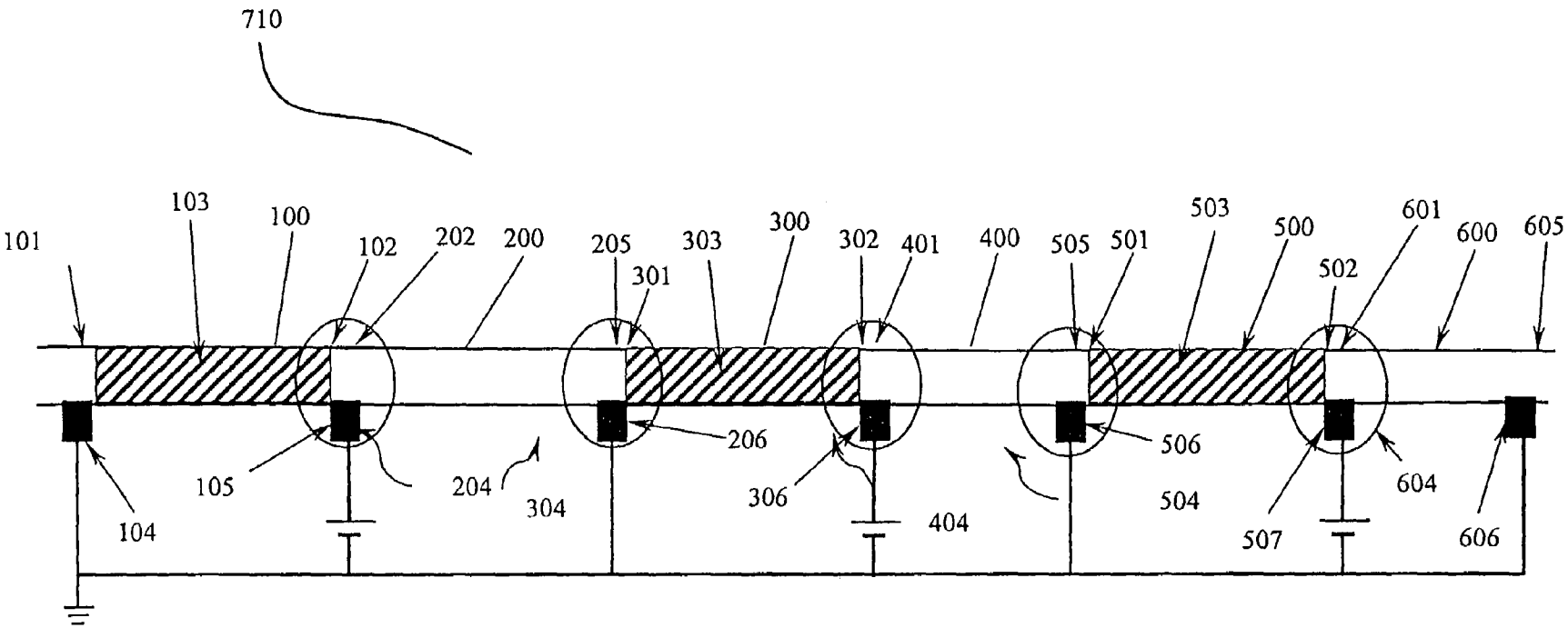
FIG. 7 illustrates an embodiment of an N-stage, 2N+1 electrode variable potential electrokinetic pump (where N=3).

FIG. 7 illustrates an embodiment, 710, of an N-stage, 2N+1 electrode electrokinetic multiplier, where N=3, configured with grounded electrodes 104 and 606 at the respective ends 101 and 605 of the first pumping stage, 100, and third conducting conduit, 600. This configuration provides for a high margin of safety and flexibility by having a ground potential at the connection ends 101 and 605 of the electrokinetic pressure multiplier, 710. In addition, electrodes, 206 and 506 also are grounded, while electrodes 105, 306 and 507 are supplied with a positive potential to provide voltage drops over pumping conduits 100, 300 and 500.

The electrokinetic multiplier may conveniently be manufactured using microfabrication techniques that allow creation of many repeated units with controlled geometries, plumbing, and controls. Microfabrication may be used to generate the porous dielectric material structures as well as carefully defining the dimensions of the conducting conduits connecting the pumping conduit sections. Microfabrication of small features in the pumping conduit such as an array of pillars is straightforward and can be easily automated by those skilled in the art. Although it is difficult to fabricate sub-micron features in materials that are well suited for holding off large voltages, the multiple stage electrokinetic multipliers permit high performance device to be constructed without having to apply excessive voltages. The ability of the electrokinetic multipliers to generate substantial pumping pressures using lowered voltages enables fabrication of high-performance microfabricated electrokinetic pumps from materials such as glass that can be etched with features of ~1 micron (present limitation for isotropic etching) and it allows high performance devices to be fabricated from materials such as silicon in which much smaller features can be fabricated but which can not tolerate high voltages.

Figure 11:
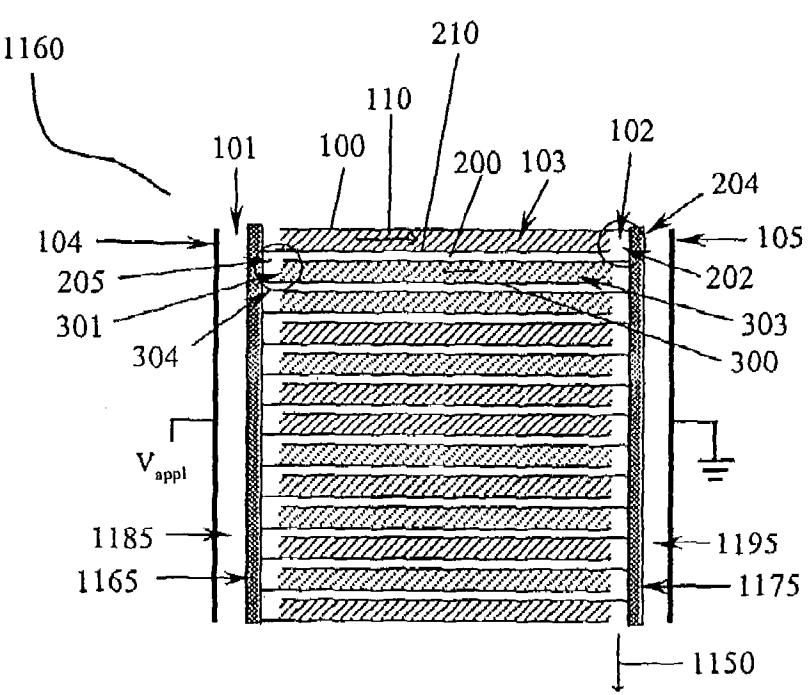
FIGS. 11*a* and 11*b* illustrate alternate embodiments of microfabricated multi-stage electrokinetic devices.
Figure 11:
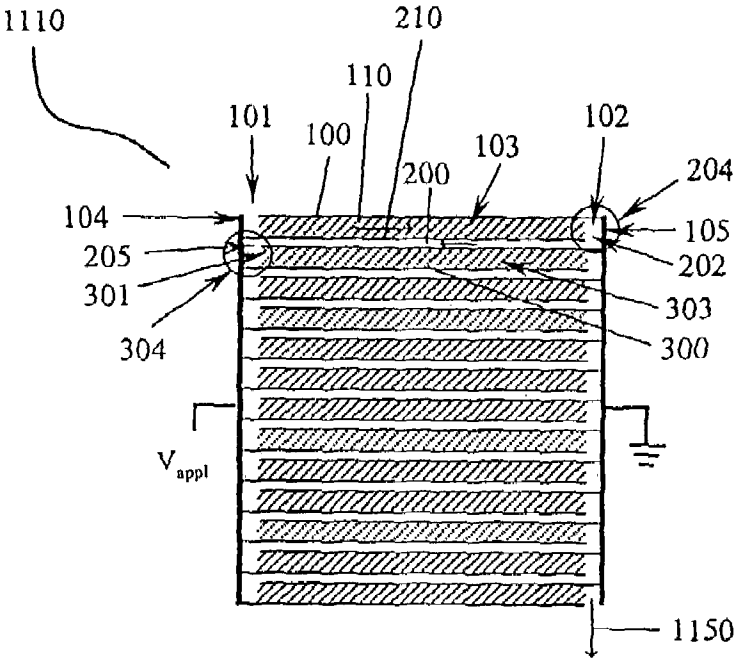
Figure 12:
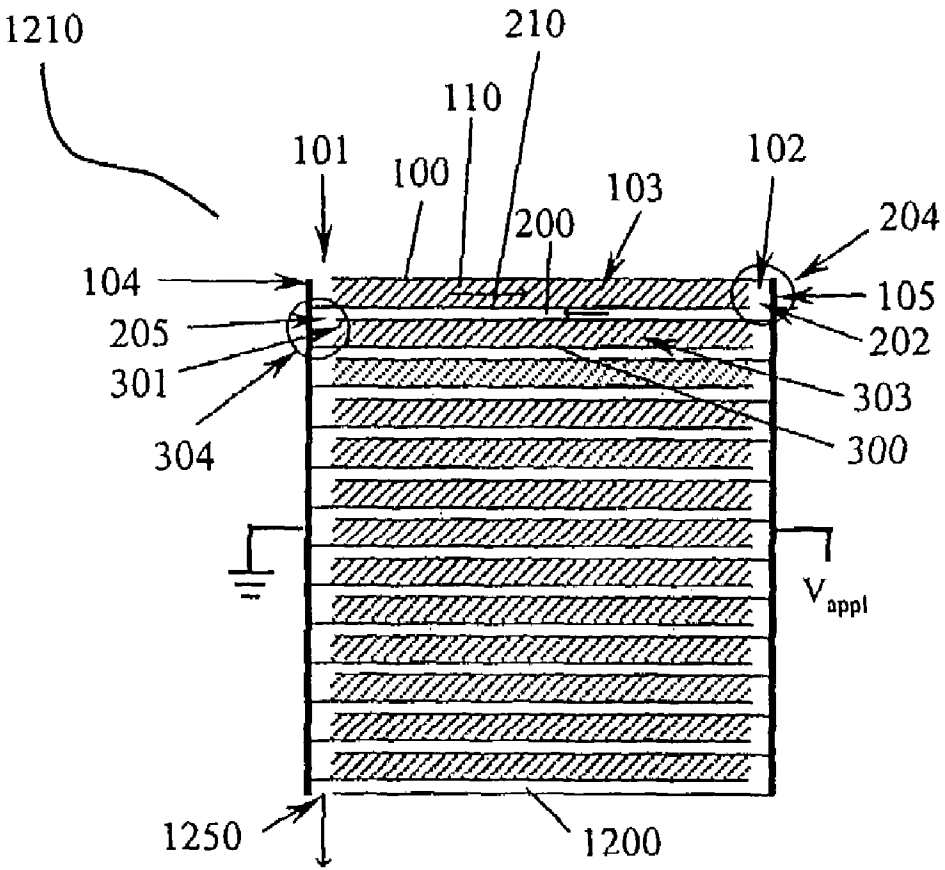
FIG. 12 illustrates an embodiment of microfabricated multi-stage variable potential electrokinetic devices.

The variable potential electrokinetic devices and electrokinetic multipliers of the present invention thus may conveniently be fabricated using etching or lithographic techniques. Examples of microfabricated pump embodiments are shown in FIGS. 11 and 12. FIG. 11*a* shows a repetitive structure that makes use of shared electrodes. FIG. 11*a* illustrates an embodiment, 1110 of an N-stage, 2N electrode electrokinetic multiplier that may be fabricated from solid substrate, such as, e.g., glass, silica, plastic or silicon, etc., and covered with a piece that seals the fluid path etched into the solid substrate. For purposes of illustration, the embodiment of FIG. 11*a* has a fluid path that enters the device at end, 101, of pumping conduit, 100. Pumping conduit, 100, containing porous dielectric material, 103, connects to conducting conduit, 200, at junction, 204, that contains electrode, 105, in electrical communication with pumping conduit end, 102, and conducting conduit end, 202. Fluid travels along a serpentine path illustrated by arrows, 110, and 210 from first pumping conduit, 100, to first conducting conduit, 200. After exiting the first conducting conduit, 200, fluid enters second pumping conduit, 300, containing porous dielectric material, 303. Junction, 304, includes electrode 206, in electrical communication with end, 205 of conducting conduit, 200, and end 301, of pumping conduit, 300. This pattern of fluid flow is repeated until fluid exits the electrokinetic pressure multiplier at end of the final pumping conduit stage, said exit point illustrated by arrow, 1150.

FIG. 11*b* illustrates the N-stage, 2N electrode electrokinetic multiplier, 1160, fabricated to include bridges, 1165, and 1175, that provide electrical communication between electrodes, 104, 105, 206, 210, etc., and ends 101, 102, 202, 205, 301, etc. of pumping conduits, 100, 300, etc., and conducting conduits, 200, etc. Electrical communication between said electrodes and said bridges is through electrolyte-filled fluid reservoirs, 1185, 1195. While the embodiments of FIGS. 11*a* and 11*b* are illustrated with one set of electrodes at $V_{Appl}$ and another set at ground, the potentials at the electrodes may be varied in accordance with the principles described above to optimize safety and performance of the electrokinetic multiplier.

FIG. 12 illustrates an N-stage, 2N+1 electrode electrokinetic multiplier, 1210 similar to those embodiments illustrated in FIGS. 11*a* and 11*b*, with the addition of a final conducting conduit, 1200. The addition of this conducting conduit permits an arbitrary voltage (illustrated as ground potential) to be applied to the end, 101, of first pumping conduit, 100, and end, 1250, of final conducting conduit, 1200, so that the fluid connection points to the electrokinetic multiplier, 1210, may be set to an arbitrary voltage, thus enhancing the safety and flexibility of the device.

Electroosmotic Flow Controllers

The present invention may be adapted for use in a flow-control mode of operation by employing a combination of pressure- and electroosmotically-driven flows in a channel, 100, filled with a porous dielectric material, 103. The applied potential preferably is selected to yield an electroosmotic flow in the same direction as the pressure-driven flow (e.g. for $TiO_2$ at high pH, hence a negative zeta potential hence a negative electroosmotic mobility, the potential would be applied with the negative terminal downstream with respect to direction of the pressure-driven flow). In this configuration the maximum flow rate through the channel, 100 will be given by the flow rate equation $Q=(\nu\Delta V-\kappa\Delta P)A/LF$ discussed below and only limited by the magnitude of the potential applied, whereas the minimum flow rate will be for purely pressure-driven flow, that is with $\Delta V=0$, hence $Q=-\kappa\Delta P\ A/LF$. Thus the combination of pressure- and electroosmotically-driven flow in a channel, 100 filled with a porous dielectric material, 104 provides a voltage-controlled means to vary the flow rate through that channel. In effect, flow control is provided by varying the degree of electroosmotic 'assist' to the pressure-driven flow through the channel. As one of skill will appreciate, sensors may be used to monitor parameters such as pressure, flow rate, etc. at one or more points in the flow controller system. Signals arising from these sensors may be used in a sense and control or servo loop to maintain the signal within a predetermined range by adjusting the voltage outputted by the power supply in response to deviations between the signal and a predetermined set point. As one of skill also will recognize, the multipliers of the present invention also may be used in a flow-control mode of operation.

Electroosmotic Flow, Pumping or Transport Fluids, and Porous Dielectric Materials Electroosmotic flow in conduits and in conduits filled with porous media are well-known phenomena and have been the subject of many experimental and theoretical studies. When a liquid (e.g. water) is in contact with a dielectric solid (e.g. glass, silica, many plastics and ceramics) the natural electrochemistry of the interaction may produce a thin layer of net charge density in the liquid that is localized to the liquid-solid interface. An electrical field applied so as to produce a component tangential to this interface will produce a Lorentz force on this net charge density. This force will cause a motion of the net charge and this motion will be imparted by viscous action to the remaining neutral liquid. Thus in a conduit, or a conduit filled with a porous dielectric material, that is further filled or saturated by an appropriate liquid, a potential difference $\Delta V$ applied end-to-end will produce what is known as an electroosmotic flow of the liquid. This electroosmotic flow may compete with or even dominate the flow that could be produced by application of a pressure difference across the same conduit.

Electroosmotic flows may be generated using a wide variety of liquids and dielectric materials. The liquid should provide conditions that yield a high zeta potential with respect to the dielectric material. The liquid may be a pure liquid or a mixture of pure liquids that may have in addition some small concentration of a conducting species such as various ions. Preferably, the pure liquids should have high dielectric constant (between about 5 and 100 relative units), low dynamic viscosity (between about 0.1 and 2 centipoise) and low conductivity (between about $10^{-4}$ and $10^{-14}$ mho/m). Additives are preferably introduced to define or control the pH and ionic strength of the liquid. Additives should be of a kind and of a concentration to completely dissolve in the liquid. The kind and concentration of these additives preferably are chosen so as to enhance or optimize the zeta potential including any conditions imposed by the size of the conduit or of the pores in any porous medium within the conduit.

Suitable pure liquids include by way of example, but not limitation: distilled and/or deionized water, cyclic carbonates, methanol, ethanol, 1-propanol, 2-propanol, 1-butanol, 1-pentanol, 1-hexanol, 1-heptanol, benzyl-alcohol, nitromethane, nitrobenzene, butanone, dimethoxymethane, dimethylacetamide, dioxane, p-dioxane, acetonitrile, formamide, tetrahydrofuran, dimethyl formamide, acetone, acetic acid, triethylamine, dichloromethane, ethylene glycol, and dimethylsulfoxide.

The zeta potential may be thought of as a property of a liquid-solid interface. It is desirable that the magnitude of this zeta potential be in the range of about unity to 150 mV. The zeta potential may be either positive or negative in sign. It is known that the sign and magnitude of the zeta potential are dependent on the dielectric constant of the liquid, the pH of the liquid, on the ionic strength of the liquid and on the type of ions in the liquid. To yield a zeta potential, generally, the surface of the dielectric material exhibits acidic or basic sites that become ionized in the presence of the liquid. These ionizable surface sites may be native or may be added to the material. Ionizable surface sites can be added to a material by chemical reaction or grafting, or may be the result of adsorption of some species onto the surface material, or may be induced by creation of reactive surface chemistry or creation of defects via treatment with a plasma or with ultraviolet or ionizing radiation.

Mechanisms for ionization for native materials include by way of example, but not limitation: silica, which exhibits acidic surface sites, alumina (amphoteric) surface sites can exhibit basic or acidic characteristics, Nylon (zwitterionic) which exhibits both acidic (carboxyl) and basic (amine) surface sites. The sign of the zeta potential is the same as the sign of the net surface charge.

As an example of adsorption leading to surface charge, consider admixtures of polyethylene or polypropylene with ionic surfactants. Polyethylene and polypropylene are nonpolar polymers having no native ionizable sites. In an aqueous solution containing certain ionic surfactants (e.g. sodium dodecyl sulfate), the hydrophobic tail of the surfactant adsorbs to the polymer. The charged end of the surfactant then appears as a charge site on the surface.

The degree of ionization of the surface sites depends on the pH of the liquid. In most cases there is a pH at which the surface is net neutral and hence the zeta potential is zero. The zeta potential reaches a maximum value for pH values well-above (for acidic surface sites) or pH values well below (for basic surface sites) the pH value at which the surface is net neutral.

The host dielectric material is selected for properties of: high zeta potential, sign of the zeta potential, insolubility and stability in the liquid with additives, low electrical conductivity, and sufficient mechanical strength.

Examples of suitable oxide materials include: silica, alumina, titania, zirconia, cerium oxide, lanthanum oxide, yttrium oxide, hafnium oxide, magnesium oxide, tantalum oxide. These oxides may be amorphous or glassy or crystalline and may be combined in mixtures having other minor oxide components.

Examples of suitable glass materials include: crown or float or boro-silicate glasses, lanthanum or flint or dense flint glasses, Pyrex™.

Examples of suitable nitride materials include: silicon nitride, boron nitride, aluminum nitride.

Examples of suitable polymers include: Nafion™ (Dupont Trade name, a sulfonated PTFE), polysulfone, polyethersulfone, cellulose acetate, mixed cellulose esters, polycarbonate, polyacrylonitrile, polyvinylidene fluoride, polyamide (Nylon), silicone elastomers, polymethacrylate, and nitro-cellulose (also called collodion).

Other classes of suitable materials include elemental sulfur, certain semiconductors, carbides (e.g. titanium carbide) and suicides (e.g. germanium silicide).

Ionic species in the liquid are termed counterions (ions that have a charge sign opposite the sign of the zeta potential) and coions (ions that have a charge sign the same as. the sign of the zeta potential). It is the net excess of surface charge-balancing counterions near the surface/liquid interface that determines the zeta potential. Increasing the concentration of counterions in the bulk liquid tends to shield the surface charge and thus reduces the magnitude of the zeta potential. For example, consider silica as the dielectric material exposed to water at pH 7 as the pure liquid and KCl as an additive. The zeta potential for this system is measured to be negative with magnitudes of: 120 mV, 100 mV, 70 mV and 30 mV for KCl concentrations of 0.1, 1, 10 and 100 millimolar, respectively. The valence of the counterion may also have a pronounced effect on the character of the zeta potential. Polyvalent (i.e.

multiply charged) counterions may bind to the surface sites thus changing the pH of zero net charge (i.e. the "isoelectric pH"). For example: silica in the presence of a singly valent counterion (e.g. $Na^+$) displays an isoelectric pH of about 2.8. Whereas silica in the presence of a bivalent counterion (e.g. $Ca^{2+}$or $Ba^{2+}$) displays an isoelectric pH in the range of 6 to 7. In this regard, the transport or pumping fluid preferably is selected or purified so as to be substantially free of polyvalent counterions.

Ionic additives to the liquid may be broken into two general classes: those that fully ionize (e.g. salts, strong acids and strong bases) and those that partially ionize (often termed weak acids and weak bases). The former class is often employed primarily to establish the ionic strength of the liquid. The latter class is often employed primarily to buffer the liquid and thus establish and maintain the pH of the liquid. The two classes often are used in conjunction. It is important to note that many but not all buffering species can exist in polyvalent states (e.g. formate exists as neutral or singly charged whereas phosphate exists as neutral, singly, doubly and triply charged). Thus the choice of a buffering compound must be made in view of the issue of polyvalent counterions discussed above.

Examples of ionic and buffering additives include but are not limited to: alkali-halide salts, mineral acids and bases, organic acids and bases, phosphates, borates, acetates, citrates, malates, formates, carbonates, chlorates, nitrates, sulfates and sulfites, nitrates and nitrites, ammonium-, methylammonium-, ethylammonium-, propylammonium-salts, BIS, MES, TRIS, TES, HEPES, TEA.

Certain compounds (sometimes termed anti-static agents) are known to alter or eliminate the zeta potential. For example special agents are added to hydrocarbon fuels to eliminate zeta potentials and thus prevent static buildup during pumping and transport. As a further example, special agents are added to shampoos and conditioners again to eliminate the zeta potential and prevent static buildup. Certain surfactants represent one class of these agents. In this regard the transport or pumping liquid is selected or purified so as to be substantially free of agents that degrade or eliminate the zeta potential.

As examples: addition of small quantities of the surfactant SDS (sodium dodecyl sulfate) is known to increase the zeta potential of silica in aqueous solutions. Whereas the effect of the surfactant CTAB (cetyl trimethylammonium bromide) on silica in water is to reduce the zeta potential upon addition at low concentrations, to bring the zeta potential value to near zero as the concentration is increased, and to reverse the sign of the zeta potential at even higher concentrations. Addition of polyamines also is known to reduce or reverse the zeta potential of silica. Surface modification properties of surfactants are reviewed by M. J. Rosen, 'Adsorption of surface-active agents at interfaces: the electrical double layer,' Chapter II in, *Surfactants and Interaction Phenomena* (Wiley, NY, 1986), pp. 33-107.

The region of net charge in the liquid and adjacent to the dielectric surface extends some distance into the liquid. The one-on-e (1/e) thickness of this layer is approximately the Debye length in the bulk liquid. The Debye length at a temperature of 20° C. has a value of 0.034 nm times the square root of the ratio of the liquid dielectric constant to the liquid ionic strength (the later taken in units of mols/liter). For one millimolar KCl in water the Debye length is about 9.6 nm.

This Debye length scale can be altered by changing the ionic strength of a given liquid and is preferably less than about one-tenth the characteristic pore size of the porous dielectric medium. For Debye lengths greater than about one-tenth the characteristic pore size, the charged layers on opposing walls of the pore begin to substantially merge having the effect of reducing the apparent zeta potential. The effect of charge-layer overlap in simple geometries (e.g. slit or circular pores) has been studied theoretically. See, e.g., C. L. Rice and R. Whitehead, 'Electrokinetic flow in a narrow cylindrical pore,' J. Phys. Chem. 69 pp. 4017-4024 (1965); and D. Burgreen and F. R. Nakache, 'Electrokinetic flow in ultrafine capillary slit,' J. Phys. Chem. 68 pp. 1084-1091 (1964). The conclusions of these studies can be applied analogously to an arbitrarily shaped conduit or to a general porous medium through the use of the dynamic pore scale, Λ, that is defined below.

In the limit of creeping flow, the pressure-driven flowrate (i.e., volume per unit time) through a conduit or through a porous medium is given by Darcy's law:

$$Q=-k_D\Delta PA/L\mu$$

Here ΔP is the applied pressure difference driving the flow, A and L are the geometrical cross sectional area and thickness of the porous medium, respectively, $k_D$ is the flow permeability or Darcy permeability of the medium and μ is the dynamic viscosity. The Darcy permeability is given by:

$$k_D=\Lambda^2M/F$$

where Λ s the dynamic pore scale, M is often termed the 'pore geometry number' and F is the 'formation factor' of the porous media.

Media topology descriptors, M and F, and the dynamic pore scale are preferably taken as defmed by D. L. Johnson and P. N. Sen, Phys. Rev. B 37, 3502-3510 (1988); D. L. Johnson, J. Koplick and J. M. Schwartz, Phys. Rev. Lett. 57, 2564-2567 (1986); and D. L. Johnson, J. Koplick and R. Dashen, J. Fluid Mech. 176, 379-392 (1987). These quantities may be interpreted as follows:

The pore geometry number, M, is dimensionless and quantifies the shape of the pores or of a conduit (round and tortuous versus thin-planar and straight, e.g.). For a wide variety of porous media, ranging from packed fibers to packed beads to sandstones to aggregates to foams, the pore topology number is experimentally and theoretically found to generally range in value between 1/32 and 1/16. For a right-regular open conduit the pore topology number reduces exactly to 1/32 times the hydraulic shape factor (e.g. 2/3 for plane parallel, unity for circular, about 1.12 for square cross section) of the conduit.

The formation factor, F, is dimensionless and quantifies the type of connectedness and the porosity of the medium. The formation factor may be thought of as equal to the square of the tortuosity divided by the connected porosity of the medium. The formation factor is by definition greater than or equal to unity, taking a unit value for a right regular open conduit of any cross sectional shape.

The dynamic pore scale, Λ, has dimensions of length. For a tube of varying diameter along its length, Λ will tend to a value near that of the limiting throat diameter. For a bundle of straight tubes of various diameters and arrayed in parallel, Λ will tend to a value near that of the largest hydraulic diameter in the bundle. For a right-regular open conduit Λ reduces exactly to the hydraulic diameter of the conduit.

It will be appreciated that the quantities M, F and Λ form a set that replace all of the traditionally descriptors (e.g. porosity, hydraulic diameter, tortuosity, Darcy permeability) employed to describe flow in porous media and flow in open conduits. In cases that include electrokinetic effects the problem is additionally specified by the Debye length scale (nominally the thickness of the double layer). Mathematically it may be shown that Λ is the appropriate length scale to determine the degree of double layer overlap. For a porous media these quantities can be measured using methods well known in the arts.

It also will be appreciated that the quantities M, F and Λ apply equally and are mathematically correct for describing flow in an open conduit of arbitrary shape. For an open conduit these quantities can be measured using methods well known in the art or can be computed using well-established algorithms.

Pores in a porous material may vary in size along the length and a variety of pore sizes may be present. Thus a general porous material, saturated with a liquid at some given ionic strength, may have some subset of pores that contain substantially overlapped regions of net charge (here termed 'nanopores') with the balance of the pores containing some amount of core liquid that is free of charge-layer overlap (here termed 'regular' pores). All of the pores will transport current hence ionic species, but the nanopores will transport flow at a greatly reduced rate compared to the regular pores. The presence of nanopores may therefore reduce the efficiency of electroosmotic flow.

The flow rate through a conduit, that may contain porous media, supporting both electroosmotic- and pressure-driven flows may be written as: $Q=(\nu\Delta V-\kappa\Delta P)A/LF$. This relation is a well known combination of Darcy's law for pressure driven flow and the Helmholtz-Smoluchowski relation generalized to include electroosmotic flow in porous media. Here $\nu$ is the effective electroosmotic mobility, $\kappa$ is the product of Darcy permeability and formation factor divided by the dynamic viscosity of the liquid, and F is the above-described formation factor. The effective mobility may be written as $\nu=\in\zeta(1-\xi)/\mu$ where $\in$ and $\mu$ are the dielectric permittivity and dynamic viscosity of the liquid, respectively, $\zeta$ is the zeta potential and $\xi$, is a factor that provides for the effect of overlapping net charge layers (i.e. a reduction of the apparent zeta potential under conditions that the thickness of the charge layers becomes on the order of the size of the pores in the media). The zeta potential, hence the electroosmotic mobility, may be signed positive or negative depending on the nature of the liquid and the dielectric material.

Porous materials may be fabricated by a wide variety of methods; examples include but are not limited to the following:

- Packed particles where the particles may be glass or ceramic or polymers. The particles may be held in place (i.e. confined in the conduit) by any method known in the art, including but not limited to end-frits or other mechanical restrictions, or by cold welding under pressure or chemical bonding, sintering, or locked-in via a sol-gel.
- Synthetic porous opaline-like materials, such as those described in, for example, A. P. Philipse, 'Solid opaline packings of colloidal silica spheres,' J. Mat. Sci. Lett. 8 pp. 1371-1373 (1989), and porous materials created by using opalines as a template, as described in, for example, J. E. G. J. Wijnhoven and W. L. Vos, 'Preparation of photonic crystals made of air spheres in titania,' Science 281 pp. 802-804 (1998).
- Phase separation and chemical leaching of a glass, for example the Vycor process as applied to a borosilicate or other composite glass as described in, for example, T. Yazawa, 'Present status and future potential of preparation of porous glass and its application,' Key Engineering Materials,' 115 pp. 125-146 (1996).
- Solgel or aerogel process in silica, alumina, titania, zirconia and other inorganic-oxides or mixtures thereof.
- Zeolite and zeolite-like porous media as described in, for example, Y. Ma, W. Tong, H. Zhou, S. L. Suib, 'A review of zeolite-like porous materials,' Microporous and Mesoporous Materials 37 pp. 243-252 (2000).
- Phase separation of polymer—inorganic oxide solutions as carried out using, for example the SilicaRod process described in, for example, K. Nakanishi and N. Soga, 'Phase separation in silica sol-gel system containing polyacrylic acid I. Gel formation behavior and effect of solvent composition,' J. Non-crystalline Solids 139 pp. 1-13 (1992).
- Direct machining by lithography and etching, molding, casting, laser ablation and other methods known in the arts. Direct machining may be used to generate, e.g., regular or irregular arrays of microconduits or pillars fabricated from a material that, in combination with a desired pumping or transport liquid, gives rise to a zeta potential. Such microconduits or pillars may be used as the porous dielectric materials of the present invention.
- Porous polymers as prepared by film stretching, sintering, track etching, casting followed by leaching or evaporation, slip casting, phase inversion, thermal phase inversion. Like methods are often employed in the manufacture of polymer filter membranes.
- Porous polymer monoliths as described in, for example, E. C. Peters, M. Petro, F. Svec and J. M. Frechet, 'Molded rigid polymer monoliths as separation media for capillary electrochromatography,' Anal. Chem. 69 pp. 3646-3649 (1997).
- Anodic etching as applied to silicon, as described in, for example, J. Drott, K. Lindstrom, L. Rosengren and T. Laurell, 'Porous silicon as the carrier matrix in micro structured enzyme reactors yielding high enzyme activities,' J. Micromech. Microeng. 7 pp 14-23 (1997) or as applied to aluminum as described in, for example, O. Jessensky, F. Muller and U. Gosele, 'Self-organized formation of hexagonal pore structure in anodic alumina,' J. Electrochem. Soc. 145 pp. 3735-3740 (1998).

The porous materials may be fabricated in-conduit (or in-conduits) or may be fabricated, machined or cut, and then inserted or sealed into the conduit (or conduits), or, as is the case with microconduit arrays, the porous dielectric material may be machined so as to require no exogenous conduit, the conduit being formed by the walls of the substrate from which the array is machined. The surface properties may be altered before or after placement within a conduit (or conduits).

The sign and magnitude of the zeta potential can be altered or enhanced by modification of the surface or bulk chemistry of the porous material as described above. Modification of surface chemistry is generally done by reaction with sites (e.g. silanol, hydroxyl, amine) that are present on the native material. Modification of the bulk chemistry generally is done by synthesis of a material that directly incorporates ionizable sites. Examples include but are not limited to the following:

- Modification of the bulk chemistry of a polysulfone or polyethersulfone or poyletherketones to convert some portion of the S═O groups to sulfonic acids. The sulfonic acid groups then provide a strongly acidic surface site.
- Modification of the bulk chemistry of PTFE to attach side chains terminated in sulfonic acid groups (Dupont product Nafion™). The sulfonic acid groups then provide a strongly acidic surface site.
- Modification of the bulk chemistry of a polyethersulfone or a polyvinyledene fluoride to introduce quaternary amines. The quaternary amine groups then provide a strongly basic surface site.

Modification of the bulk or surface chemistry of a polyamide (Nylon) to provide a material with only carboxy (acidic) or amine (basic) surface sites.

Modification of a zwitterionic material (e.g. Nylon) to terminate one of the existing ionizable sites with a non-ionizable end group. The material is then converted to one having only a basic or an acidic site, rather than one having both types.

Activation of a polymer material by introduction of defects or creation of cross-links via exposure to a plasma, ultraviolet or ionizing radiation. This creates reactive surface sites such as carboxyls.

Modification of surface silanol groups with methoxy- or chloro-silanes to create amino groups or sulfonic acid groups.

The porous dielectric material is contained in a liquid-impermeable 'conduit' having a liquid inlet and outlet and preferably spaced electrodes for applying a potential difference to the liquid. Conduit materials are selected to meet requirements for mechanical strength, dielectric breakdown strength, transport or pumping liquid and liquid additive compatibility, and the capacity to retain the porous dielectric material. The possible geometries of the conduit cover the entire range from long in length and small cross section to short in length and large cross section. An example of the former geometry is a conduit that may be a capillary tube or a covered microconduit formed in a substrate having cross sectional shapes including round to rectangular to rectangular with sloped or curved sides. This conduit may be formed by any of the means known in the art. An example of the latter geometry is a large diameter and thin porous membrane.

The choice of pore size, topology numbers and physical geometry (e.g. conduit thickness and cross-sectional area) are particular to a given application. This then drives the needs for ionic strength and buffering capacity. In general, the following considerations may be taken into account for practicing preferred embodiments of the present invention.

Use of singly valent counterions for a well-defined hence well-behaved zeta potential.

Use of absence of compounds in the pumping or transport fluid that degrade or eliminate the zeta potential.

Use of the lowest concentration of ionic species compatible with 'minimal' double layer overlap (i.e. a concentration yielding a liquid Debye length that is less than about one-fifth the characteristic pore size).

Use of the lowest concentration of buffering ionic species consistent with establishing and maintaining the pH of the pumping or transport fluid.

Use of ionic species that are compatible with, well soluble, and well dissociated in the pumping or transport fluid.

A pore size distribution that is preferably monodisperse and if polydisperse does not contain occasional large pores or defects (e.g. cracks or voids) and contains no or a minimal number of 'nanopores.'

Use of a porous dielectric material that is less conducting than the pumping or transport liquid including any additives.

Use of a porous dielectric material with a dielectric strength sufficient to withstand the potentials applied without dielectric breakdown.

Use of a porous dielectric material that is mechanically strong enough to withstand the pressures applied or generated both as regards the ability to withstand compression and collapse, and the ability to remain attached to the material of the bounding conduit or conduit.

Use of a porous dielectric material that is resistant and insoluble in the pumping or transport or working liquid including any additives.

Use of a conduit or conduit material that is an insulator, and in particular the material should be less conducting than the pumping or transport or working liquid including any additives.

Use of a conduit or conduit material with a dielectric strength sufficient to withstand the potentials applied without dielectric breakdown.

Use of a conduit or conduit material that is mechanically strong enough and thick enough to withstand the pressures applied or generated.

Use of a conduit or conduit material that is resistant and insoluble in the pumping or transport fluid including any additives.

Use of a pumping or transport fluid with a high value of the dielectric constant and a low value of the dynamic viscosity.

Use of a combination of pumping or transport fluid, surface chemistry and additive ionic species chemistry that provides a high value of the zeta potential.

Use of a pumping or transport fluid that is a pure fluid or a highly miscible mixture of pure fluid.

EXAMPLES

Example 1

Construction of 1 Stage, Three Electrode Variable Potential Electrokinetic Pumps Two variations of one stage, three electrode variable potential electrokinetic pumps, according to the embodiments illustrated in FIGS. 2*c* and 2*d* were constructed as follows. The pumping conduits were constructed by packing 1.6 μm nonporous silica beads (Bangs Laboratory, Inc., Fishers IN) in a 150 μm i.d. capillary (PolymicroTechnologies, LLC, Phoenix Ariz.) which was 5.5 cm in length. The particles, which when packed, provided the porous dielectric material, were contained in the capillary by sintering the particles to form frits of ~1 mm with a thermal wire stripper. The conducting conduits were constructed using open capillaries (PolymicroTechnologies, LLC, Phoenix Ariz.) with 50 μm i.d. and 10 cm in length. The capillaries were connected together with conventional high-pressure fittings (Upchurch Scientific, Oak Harbor Wash.). Electrodes were constructed using a platinum wire in a fluid reservoir and a nanoporous silica bridge (Akagawa Koshitsu Glass Co., LTD, Osaka City Japan), one end of which was in the fluid reservoir and the other end was inserted into one opening in a high-pressure cross fitting used to connect the capillaries.

Pressures were measured by connecting a pressure transducer (PSI-Tronix, Tulare, Calif.) to the grounded end of the second conduit via a 150 μm i.d. capillary. The pressures were recorded using a conventional A-to-D converter board on a standard personal computer. The pumping fluid was a 5 mM borax buffer with a pH of 9. In this example, $p^{ek}_c/p^{ek}_p \sim 2.9\times 10^{-4}$, $k_c/k_p \sim 3.5\times 10^3$ and $R_c/R_p \sim 4$. The very small value of $p^{ek}_c/p^{ek}_p$ and large value of $k_c/k_p$ allow for generation of high pressure, and for effective use of the flow rate generated by the pumping conduit.

Figure 8:
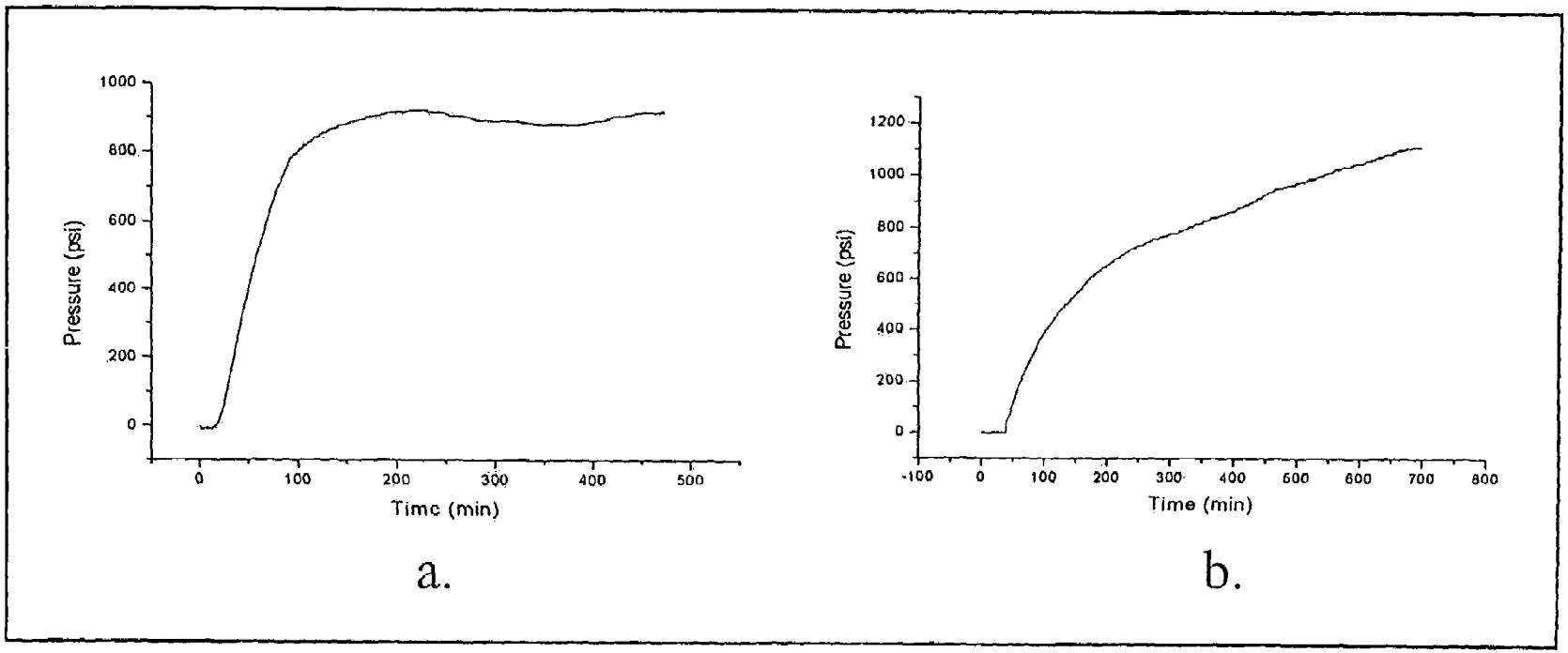
FIGS. 8*a* and 8*b* show plots of pressure (as psi) as a function of time for the embodiments of the variable potential electrokinetic devices respectively illustrated in FIGS. 2*c* and 2*d* and operated as pumps with a 1 kV voltage across the pumping conduit.

Running each of these pumps with a 1 kV voltage difference across the pumping medium, stagnation pressures in excess of 950 psi were measured (i.e., approximately 1 psi/volt was generated) (see FIGS. 8*a* and 8*b*). The observed pressures are comparable to those generated using the same pumping medium in configurations omitting the conducting conduit section (200) indicating little loss of pumping efficiency due to the added conducting conduit section. With $R_c/R_p$~4 the conducting conduit only increases the total current drawn by the device by 25%.

Example 2

Electrokinetic Pressure Multiplier

Figure 9:
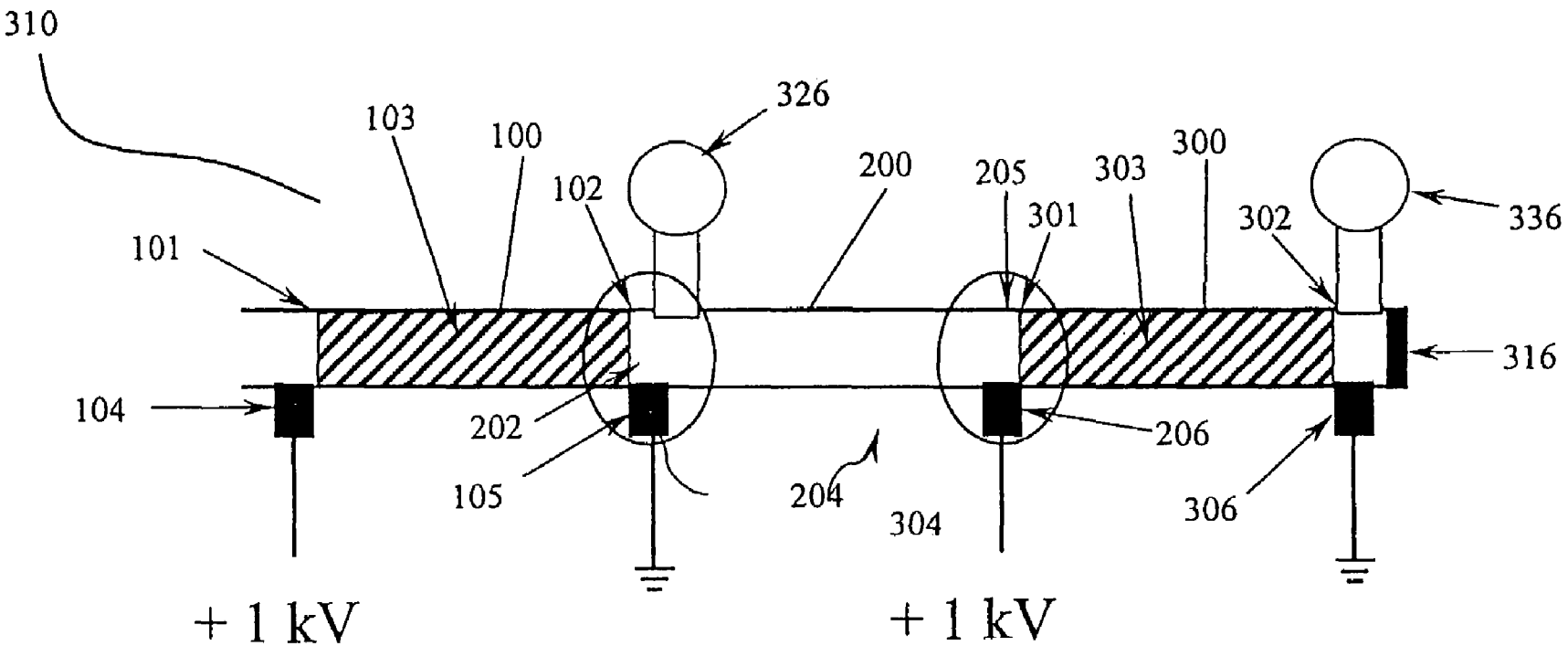
FIG. 9 illustrates a two-stage variable potential electrokinetic pump configuration for determining stagnation pressure generation.
Figure 10:
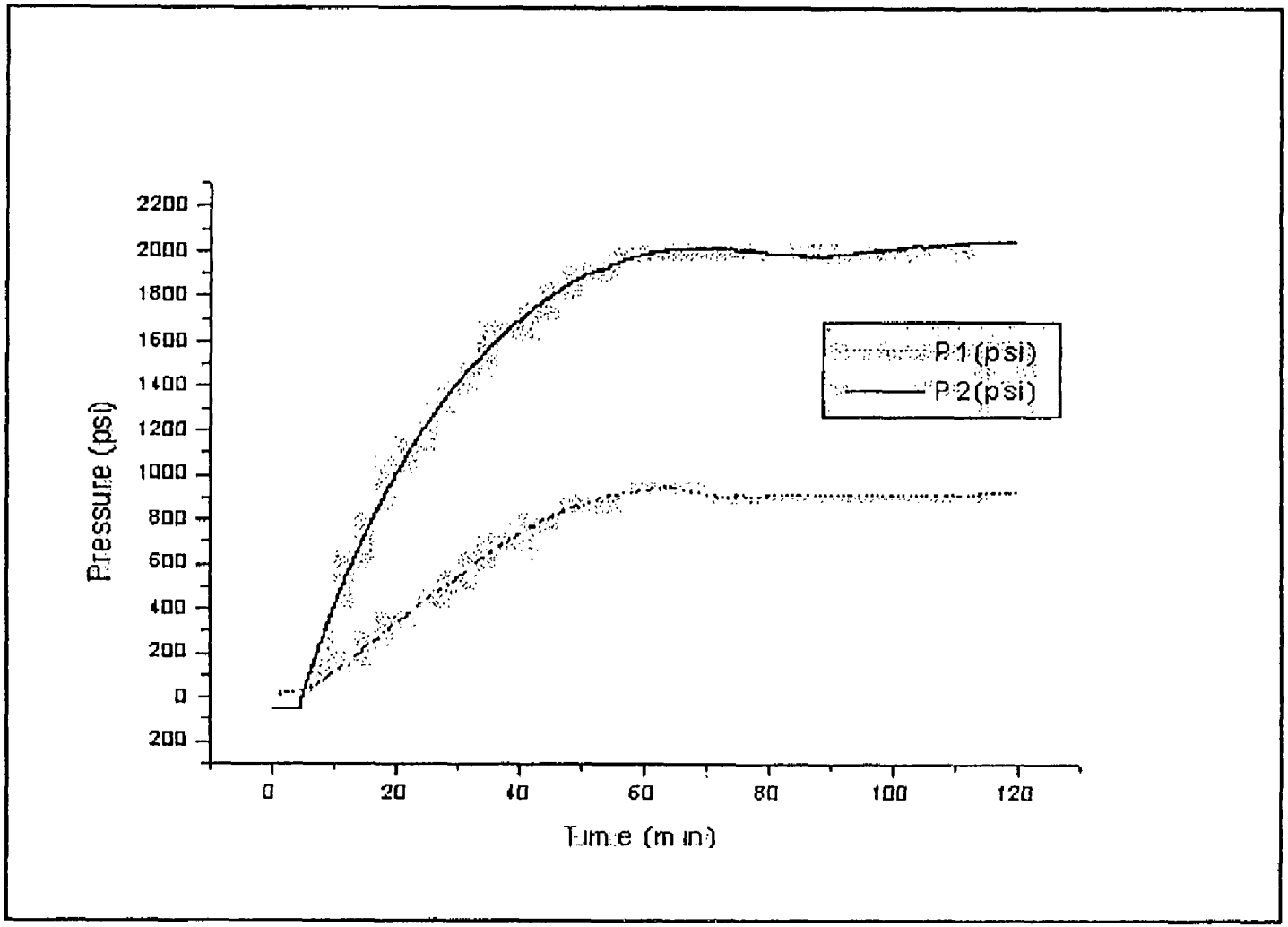
FIG. 10 shows a plot of pressure (as psi) as a function of time for the two-stage variable potential electrokinetic pump illustrated in FIG. 9 operated with a 1 kV voltage difference across the two ends of each pumping conduit.

The two pumps constructed and tested in Example 1 were joined together with a high pressure low dead volume fitting to create an electrokinetic pressure multiplier that was tested with the same pumping fluid as used in Example 1. The configuration of the electrokinetic multiplier is illustrated in FIG. 9. The electrokinetic pressure multiplier was constructed in a similar fashion with similar components as the previous example of the variable potential electrokinetic pump. Pressure transducers 326, and 336 were attached to the electrokinetic pressure multiplier to permit monitoring of the pressure at junction, 204, and at the end, 302, of the second stage pumping conduit, 300; the outlet of the device was terminated into a fitting that was connected to the pressure transducer which permitted measurement of stagnation pressure. The two pumps were run in series in the amplification scheme and the pressure at the outlet was monitored. The amplified pressure (buildup shown in FIG. 10) was greater than 2000 psi with 1000 V applied (>2 psi/volt) indicating a successful amplification of the pressure for a given applied voltage. The time required to reach maximum pressure reflects the compressibility of water, the flow rate of the pump and the finite volume of water in the pressure transducers and fittings.

The foregoing description and figures are intended to illustrate but not limit the scope of the invention. Variations of what has been described will be apparent to those skilled in the art and are encompassed by invention described above, the scope of which is to be limited only by the claims. All references to patents, patent applications, and other publications are herein incorporated by reference in their entirety for any and all purposes.

The invention claimed is:

1. An electrokinetic device comprising:

a solid substrate, wherein the solid substrate comprises a fluid path formed in the solid substrate;

a plurality of pumping conduits in the fluid path, each having a first end and a second end and comprising a porous dielectric material;

a first electrode, wherein the first electrode is in electrical communication with the first end of each of the pumping conduits when the fluid path contains a transport fluid in which electroosmotic flow can be induced;

a plurality of conducting conduits in the fluid path, each having a first end and a second end, wherein the first end of each of the conducting conduits is in fluid communication with the second end of one of the pumping conduits;

a second electrode in electrical communication with the second end of each of the pumping conduits when the fluid path contains the transport fluid; and a cover on the solid substrate which seals the fluid path.

2. An electrokinetic device comprising:

a solid substrate, wherein the solid substrate comprises a fluid path formed in the solid substrate:

a first pumping conduit in the fluid path having a first end and a second end, said first pumping conduit comprising a porous dielectric material, wherein the porous dielectric material of the first pumping conduit comprises a non-polar polymeric surface with an ionic material adsorbed thereon, the ionic material having a hydrophobic end and a charged end, wherein the hydrophobic end of the ionic material is adsorbed onto the non-polar polymeric surface, the charged end of the ionic material thereby providing a charged site on the non-polar polymeric surface;

a first electrode, wherein the first electrode is in electrical communication with the first end of the first pumping conduit when the fluid path contains a transport fluid in which electroosmotic flow can be induced;

a first conducting conduit having a first end and a second end, wherein the first end of the first conducting conduit is in electrical communication with the second end of the first pumping conduit at a first junction when the fluid path contains the transport fluid;

a second electrode in electrical communication with the second end of the first pumping conduit and with the first end of the first conducting conduit at the first junction when the fluid path contains the transport fluid; and a cover on the solid substrate which seals the fluid path.

3. The device of claim 2, wherein the ionic material is a surfactant.

4. The device of claim 2, wherein the non-polar polymeric surface comprises a polymer material selected from the group consisting of polyethylene and polypropylene.

5. The device of claim 2, wherein the porous member comprises packed particles.

6. An electrokinetic device comprising:

a solid substrate, wherein the solid substrate comprises a fluid path formed in the solid substrate;

a plurality of pumping conduits in the fluid path, each having a first end and a second end and comprising a porous dielectric material;

a first electrode, wherein the first electrode is in electrical communication with the first end of each of the pumping conduits when the fluid path contains a transport fluid in which electroosmotic flow can be induced;

a plurality of conducting conduits in the fluid path, each having a first end and a second end, wherein the first end of each of the conducting conduits is in fluid communication with the second end of one of the pumping conduits;

a second electrode in electrical communication with the second end of each of the pumping conduits when the fluid path contains the transport fluid; and a cover on the solid substrate which seals the fluid path, wherein the porous dielectric material of at least one of the pumping conduits comprises a non-polar polymeric surface with an ionic material adsorbed thereon, the ionic material having a hydrophobic end and a charged end, wherein the hydrophobic end of the ionic material is adsorbed onto the non-polar polymeric surface, the charged end of the ionic material thereby providing a charged site on the non-polar polymeric surface.

7. An electrokinetic device comprising:

(a) a conduit; and (b) a porous member within the conduit, the porous member comprising a non-polar polymeric surface with an ionic material adsorbed thereon, the ionic material having a hydrophobic end and a charged end, wherein the hydrophobic end of the ionic material is adsorbed onto the non-polar polymeric surface, the charged end of the ionic material thereby providing a charged site on the non-polar polymeric surface.

8. The device of claim 7, wherein the ionic material is a surfactant.

9. The device of claim 7, wherein the non-polar polymeric surface comprises a polymer material selected from the group consisting of polyethylene and polypropylene.

10. The device of claim 7, wherein the porous member comprises packed particles.

* * * * *